US010960282B2

(12) United States Patent
Hsu et al.

(10) Patent No.: US 10,960,282 B2
(45) Date of Patent: Mar. 30, 2021

(54) POOL WITH AN ANNULAR LANE

(71) Applicant: INTEX INDUSTRIES XIAMEN CO. LTD., Fujian (CN)

(72) Inventors: Yaw Yuan Hsu, Fujian (CN); Zhi Xiong Huang, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 16/477,334

(22) PCT Filed: Jan. 11, 2018

(86) PCT No.: PCT/IB2018/050186
§ 371 (c)(1),
(2) Date: Jul. 11, 2019

(87) PCT Pub. No.: WO2018/130971
PCT Pub. Date: Jul. 19, 2018

(65) Prior Publication Data

US 2019/0351302 A1 Nov. 21, 2019

(30) Foreign Application Priority Data

Jan. 11, 2017 (CN) ..... 201710019460.2

(51) Int. Cl.
*A63B 69/12* (2006.01)
*E04H 4/00* (2006.01)
(Continued)

(52) U.S. Cl.
CPC ..... *A63B 69/125* (2013.01); *E04H 4/0056* (2013.01); *E04H 4/12* (2013.01);
(Continued)

(58) Field of Classification Search
CPC ..... E04H 4/0056; E04H 4/12; E04H 4/14; E04H 4/143; E04H 4/0018; A63B 69/125;
(Continued)

(56) References Cited

U.S. PATENT DOCUMENTS 1,630,797 A 5/1927 Marwick
1,664,140 A 3/1928 Tucker
(Continued)

FOREIGN PATENT DOCUMENTS

CN 2622319 Y 6/2004
CN 204326597 U 5/2015
(Continued)

OTHER PUBLICATIONS

International Search Report and Written Opinion for PCT/IB2018/050186, dated May 4, 2018, 10 pages.
(Continued)

*Primary Examiner* — Benjamin R Shaw
(74) *Attorney, Agent, or Firm* — Faegre Drinker Biddle & Reath LLP

(57) ABSTRACT

A pool includes a main pool body defining an inner cavity, and a pillar within the inner cavity which cooperates with the main pool body to define an annular lane therebetween. The pillar provides the pool greater functionality that extends beyond the scope of the traditional pool, such as by enabling a separate pool, a platform, or other structures to coexist with the annular lane within the inner cavity. Further, a flow generating device may be provided to generate a circulating water flow within the pool that moves around the annular lane.

32 Claims, 27 Drawing Sheets

(51) Int. Cl.
*E04H 4/12* (2006.01)
*E04H 4/14* (2006.01)

(52) U.S. Cl.
CPC ..... *E04H 4/14* (2013.01); *A63B 2209/08* (2013.01); *A63B 2209/10* (2013.01); *A63B 2225/605* (2013.01)

(58) Field of Classification Search
CPC ..... A63B 2209/08; A63B 2209/10; A63B 2209/605
USPC ..... 4/509
See application file for complete search history.

(56) References Cited

U.S. PATENT DOCUMENTS 1,961,061 A 5/1934 McCulloch
2,035,835 A * 3/1936 Raber ..... A63B 69/125 4/488
2,505,845 A 5/1950 Alvarez
2,529,872 A 11/1950 Hasselquist
3,476,106 A 11/1969 Ritz et al.
3,534,413 A 10/1970 Plasseraud
3,858,877 A * 1/1975 Lundstrom ..... A63B 67/04 473/14
4,001,899 A 1/1977 Mathis
4,115,878 A 9/1978 Johnson et al.
4,352,215 A 10/1982 Laing
4,375,337 A 3/1983 Yerger
4,379,438 A 4/1983 Peardon
4,420,846 A 12/1983 Bonner
4,502,168 A 3/1985 Jaworski
4,510,632 A 4/1985 Elsis
4,523,340 A 6/1985 Watkins
4,525,881 A 7/1985 Higginbotham
4,561,133 A 12/1985 Laing
4,599,753 A * 7/1986 Goodman ..... A61H 33/0091 220/694
4,651,360 A 3/1987 Wang
4,665,572 A 5/1987 Davidson et al.
4,731,887 A 3/1988 Henkin et al.
4,763,366 A 8/1988 Moreland
4,773,104 A 9/1988 Wang
4,780,917 A 11/1988 Hancock
4,843,659 A 7/1989 Popovich et al.
4,845,787 A 7/1989 Lior
4,853,987 A 8/1989 Jaworski
4,903,352 A 2/1990 Murakami
4,907,304 A 3/1990 Davidson et al.
4,920,588 A 5/1990 Watkins
4,935,970 A * 6/1990 Aristone ..... E04H 4/0025 4/488
5,005,228 A 4/1991 Mermelstein
5,044,021 A 9/1991 Murdock
5,095,558 A 3/1992 Howard
5,167,041 A 12/1992 Burkitt, III
5,172,754 A 12/1992 Graber et al.
5,226,408 A 7/1993 Drysdale
D340,276 S 10/1993 Van Ausdall
5,291,621 A 3/1994 Mathis
5,298,003 A 3/1994 Weihe et al.
5,379,467 A 1/1995 Lochbaum
5,408,708 A 4/1995 Mathis
5,495,627 A 3/1996 Leaverton et al.
5,518,431 A * 5/1996 Staley ..... A47C 15/006 441/130
5,570,481 A 11/1996 Mathis et al.
5,572,750 A * 11/1996 Johnston ..... E04H 4/14 4/494
5,597,288 A 1/1997 Hatanaka
5,662,557 A 9/1997 Watterson et al.
5,662,558 A 9/1997 Shannon, III
5,758,369 A 6/1998 Takahashi et al.
5,862,543 A 1/1999 Reynoso et al.
5,915,849 A 6/1999 Dongo
5,920,925 A 7/1999 Dongo
5,953,767 A 9/1999 Cloffey
5,983,416 A 11/1999 Idland
6,000,073 A 12/1999 Eddington
6,009,574 A 1/2000 Moreland
6,030,180 A 2/2000 Clarey et al.
6,065,161 A 5/2000 Mateina et al.
6,123,274 A 9/2000 Perdreau et al.
6,165,358 A 12/2000 Denkewicz, Jr. et al.
6,233,754 B1 5/2001 Ajima
6,263,522 B1 7/2001 Dongo et al.
6,412,123 B1 * 7/2002 Lau ..... A61H 33/60 4/492
6,454,523 B1 9/2002 Loyd et al.
6,578,207 B1 6/2003 Fratilla
6,592,341 B1 7/2003 Olney
6,595,861 B1 7/2003 Morrow et al.
6,675,404 B2 1/2004 Brennan et al.
6,688,845 B2 2/2004 Pages Pages
6,692,645 B1 2/2004 Gargas
6,789,278 B2 9/2004 Shea
6,797,164 B2 9/2004 Leaverton
6,857,967 B2 2/2005 Loyd et al.
6,859,953 B1 3/2005 Christensen
6,968,581 B2 11/2005 Christensen
7,001,159 B2 2/2006 Peterson, Jr. et al.
7,067,056 B2 6/2006 Collins
7,252,761 B2 8/2007 Lamberts Van Assche
D554,729 S 11/2007 Peterson
7,296,308 B2 11/2007 Turner
7,493,665 B2 2/2009 Williams
7,526,820 B2 5/2009 Murdock et al.
7,531,092 B2 5/2009 Hazlehurst
7,712,161 B2 5/2010 Reynolds, II
7,818,826 B2 10/2010 Schmidt et al.
7,984,519 B1 7/2011 Hall
8,011,032 B2 9/2011 Cline et al.
8,104,110 B2 1/2012 Caudill et al.
8,141,180 B2 3/2012 Hof
8,186,517 B2 5/2012 Bowman et al.
8,214,936 B2 7/2012 Thweatt, Jr.
8,262,316 B2 9/2012 Slater et al.
8,453,275 B2 6/2013 May et al.
8,607,372 B2 12/2013 Hall
8,689,370 B2 4/2014 Fleischer
8,702,387 B2 4/2014 Gillette
8,739,322 B2 6/2014 Hof
8,907,616 B2 12/2014 Liu et al.
D741,436 S 10/2015 Lin et al.
9,468,583 B2 10/2016 Lin et al.
D788,247 S * 5/2017 Lin ..... D21/815
10,193,329 B2 1/2019 Lin et al.
2003/0200604 A1 10/2003 Loyd et al.
2004/0040908 A1 3/2004 Orava et al.
2004/0148693 A1 8/2004 Anderson
2006/0021129 A1 2/2006 Williams et al.
2006/0124535 A1 6/2006 Harbol
2006/0137087 A1 6/2006 Carreau et al.
2006/0226060 A1 10/2006 Mercer
2006/0282943 A1 12/2006 Vandecamp
2007/0039092 A1 * 2/2007 Murdock ..... E04H 4/144 4/496
2007/0039876 A1 2/2007 Gori
2007/0094784 A1 5/2007 Tran
2007/0214560 A1 9/2007 Chivers et al.
2007/0271693 A1 * 11/2007 Yotsuyanagi ..... E04H 4/12 4/507
2008/0016610 A1 1/2008 Kuo et al.
2008/0086810 A1 4/2008 Le
2008/0148470 A1 6/2008 Ferriss et al.
2009/0100589 A1 4/2009 Peterson, Jr. et al.
2009/0133766 A1 5/2009 Elnar
2009/0158518 A1 6/2009 Southon et al.
2010/0058528 A1 3/2010 Clarey
2010/0064428 A1 3/2010 Loyd et al.
2010/0269251 A1 10/2010 DeMotts
2010/0294759 A1 11/2010 Yu
2010/0306916 A1 * 12/2010 Fraenkel ..... E04H 4/0006 4/509

(56) References Cited

U.S. PATENT DOCUMENTS

| | | | | |
|---|---|---|---|---|
| 2011/0004993 | A1 | 1/2011 | Frei | |
| 2011/0247970 | A1 | 10/2011 | Evingham | |
| 2011/0253638 | A1 | 10/2011 | Easland et al. | |
| 2012/0090087 | A1 | 4/2012 | Korupp et al. | |
| 2012/0117724 | A1 | 5/2012 | Caudill et al. | |
| 2013/0031711 | A1 | 2/2013 | Walsh et al. | |
| 2013/0034430 | A1 | 2/2013 | Braswell | |
| 2013/0145539 | A1 | 6/2013 | Cooke | |
| 2013/0334113 | A1 | 12/2013 | Erlich | |
| 2014/0047632 | A1 | 2/2014 | Hall | |
| 2014/0101840 | A1 | 4/2014 | Harder | |
| 2014/0331398 | A1 | 11/2014 | Walsh et al. | |
| 2015/0295397 | A1* | 10/2015 | Lin | F16M 11/046 4/491 |
| 2017/0216697 | A1* | 8/2017 | Cameron | F04D 13/12 |
| 2018/0333624 | A1* | 11/2018 | Wilson | A63F 9/0204 |

FOREIGN PATENT DOCUMENTS

| | | | |
|---|---|---|---|
| CN | 204826768 | U | 12/2015 |
| CN | 107338976 | A | 11/2017 |
| CN | 206667838 | U | 11/2017 |
| DE | 3408217 | | 9/1985 |
| EP | 0614684 | | 9/1994 |
| EP | 1217148 | A1 | 6/2006 |
| EP | 1705318 | A2 | 9/2006 |
| GB | 2150022 | A | 6/1985 |

OTHER PUBLICATIONS

Endless Pools, "Fastlane Pool: Cost effective and easy to install for a quality swim, year-round," available at http://www.endlesspools.com/fastlane-pool.php at least as early as Dec. 18, 2014, 1 page.

* cited by examiner

POOL WITH AN ANNULAR LANE

CROSS REFERENCE TO RELATED APPLICATION

This application is a national stage application based on International Patent Application No. PCT/IB2018/050186, filed Jan. 11, 2018, which claims priority to the following Chinese patent application, the disclosures of which are hereby expressly incorporated by reference herein in their entirety:

| application No. | Filing Date |
|---|---|
| CN 201710019460.2 | Jan. 11, 2017 |

FIELD OF THE DISCLOSURE

The present disclosure relates to a pool assembly, and more particularly, to a pool assembly with an annular lane.

BACKGROUND OF THE DISCLOSURE

Swimming or relaxing at the pool is a common hobby among people during the warmer months of the year. For many pool users, an inflatable pool can be set up on one's own property. The traditional inflatable pool is single-function as it is made primarily for swimming. However, traditional inflatable pool designs do not facilitate the user's entry or exit, and may provide inadequate dry surfaces for a user's possessions such as mobile phones or drinks.

SUMMARY

The present disclosure provides a pool including a main pool body defining an inner cavity, and a pillar with in the inner cavity which cooperates with the main pool body to define an annular lane therebetween. The pillar provides the pool greater functionality that extends beyond the scope of the traditional pool, such as by enabling a separate pool, a platform, or other structures to coexist with the annular lane within the inner cavity. Further, a flow generating device may be provided to generate a circulating water flow within the pool that moves around the annular lane.

In one form thereof, the present disclosure provides a pool comprising: a pool body including a wall and a bottom defining an inner cavity configured to receive water; a pillar positioned within the inner cavity, the pillar coupled to the bottom of the pool body; wherein the pillar is connected to the bottom of the pool body by a connecting strap that couples a bottom surface of the pillar to the bottom of the pool body; and wherein the pillar cooperates with the wall of the pool body to define an annular lane therebetween; and a flow generating device configured to drive the water to flow and cycle in one direction within the annular lane.

In another form thereof, the present disclosure provides a pool comprising: a pool body including a wall and a bottom defining an inner cavity configured to receive water; a pillar positioned within the inner cavity and cooperating with the wall of the pool body to define an annular lane therebetween, the pillar connected to the bottom of the pool body by a connecting strap that joins a bottom surface of the pillar to the bottom of the pool body, the pillar; and a flow generating device comprising a motor configured to drive the water to flow and cycle in one direction within the annular lane; and a hanging device comprising: a hanging member with an upper end hanging to an edge of the pool; and a mounting member connected to the hanging member, the mounting member configured to be fixed to the motor, the mounting member including a main body and an angle adjustment mechanism, wherein one side of the main body is fixedly connected with the motor, and the other side of the main body faces the wall of the pool and is connected to the angle adjustment mechanism, and the angle adjustment mechanism having an abutting block movable towards the wall of the pool and the abutting block connected with the wall of the pool.

In yet another form thereof, the present disclosure provides a pool comprising: a pool body including a wall and a bottom to define an inner cavity configured to receive water; and a pillar including a pillar body and a connecting strap, the pillar positioned within the inner cavity to define an annular lane between the wall of the pool body, the pillar coupled to the bottom of the pool body by the connecting strap that connects a bottom surface of the pillar body to the bottom of the pool body, wherein the pillar body is configured to float on a surface of water contained in the inner cavity under the action of buoyancy, and the connecting strap is in a tensioned state under the action of the buoyancy.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
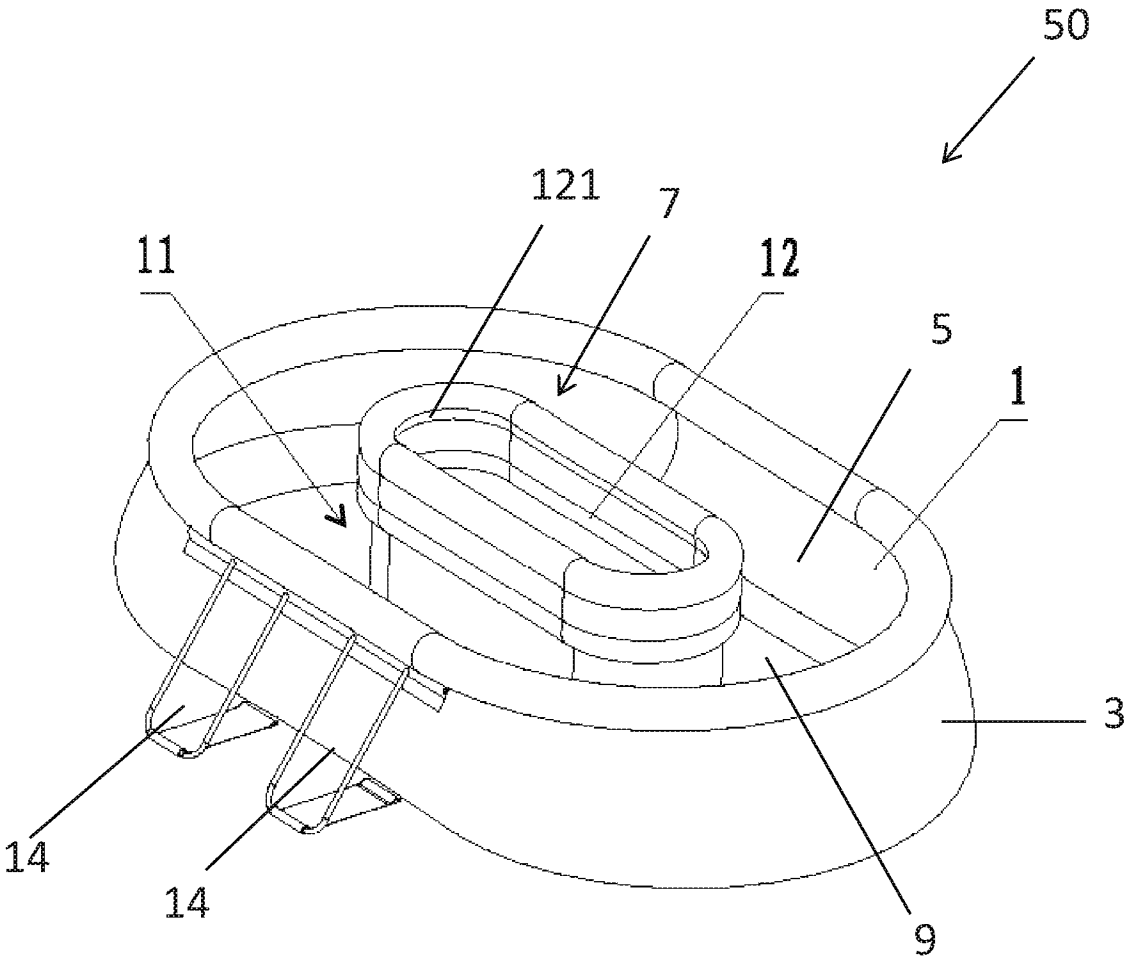
FIG. 1 is a perspective view of a pool made in accordance with the present disclosure.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Figure 2:
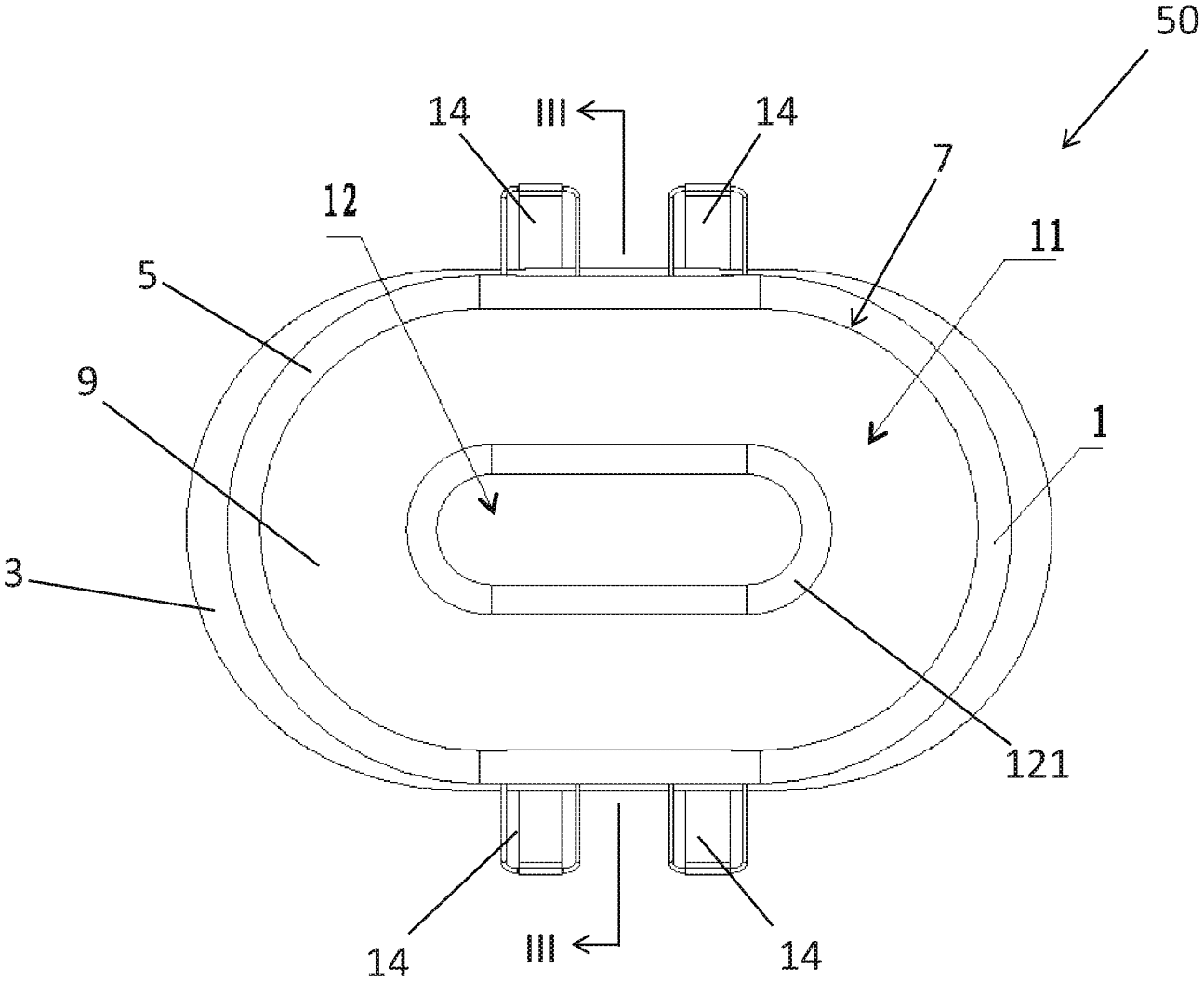
FIG. 2 is a top plan view of the pool of FIG. 1.

Referring first to FIGS. 1 and 2, pool 50 includes a main pool body 1 and a generally central pillar 12 which cooperates with the pool body 1 to create an annular lane 11 around the periphery of pool 50. Pool body 1 includes wall 5 (which may be single- or multi-layer), and bottom 9. Wall 5 and bottom 9 cooperate to define an inner cavity 7 within which pillar 12 is positioned. Pool 50 further includes external supports 14 that support pool body 1 and help to retain the desired shape, given that pool body 1 may be made from a flexible or semi-rigid material.

Figure 4:
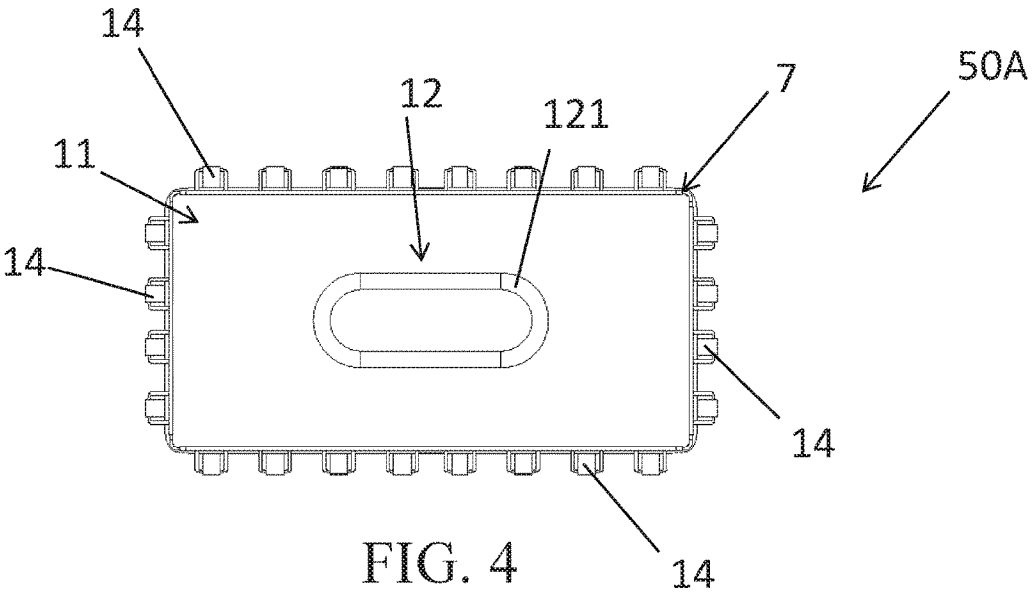
FIG. 4 is a top plan view of an alternate embodiment of the pool of FIG. 1, in which a rectangular swimming area is present within the pool.
Figure 5:
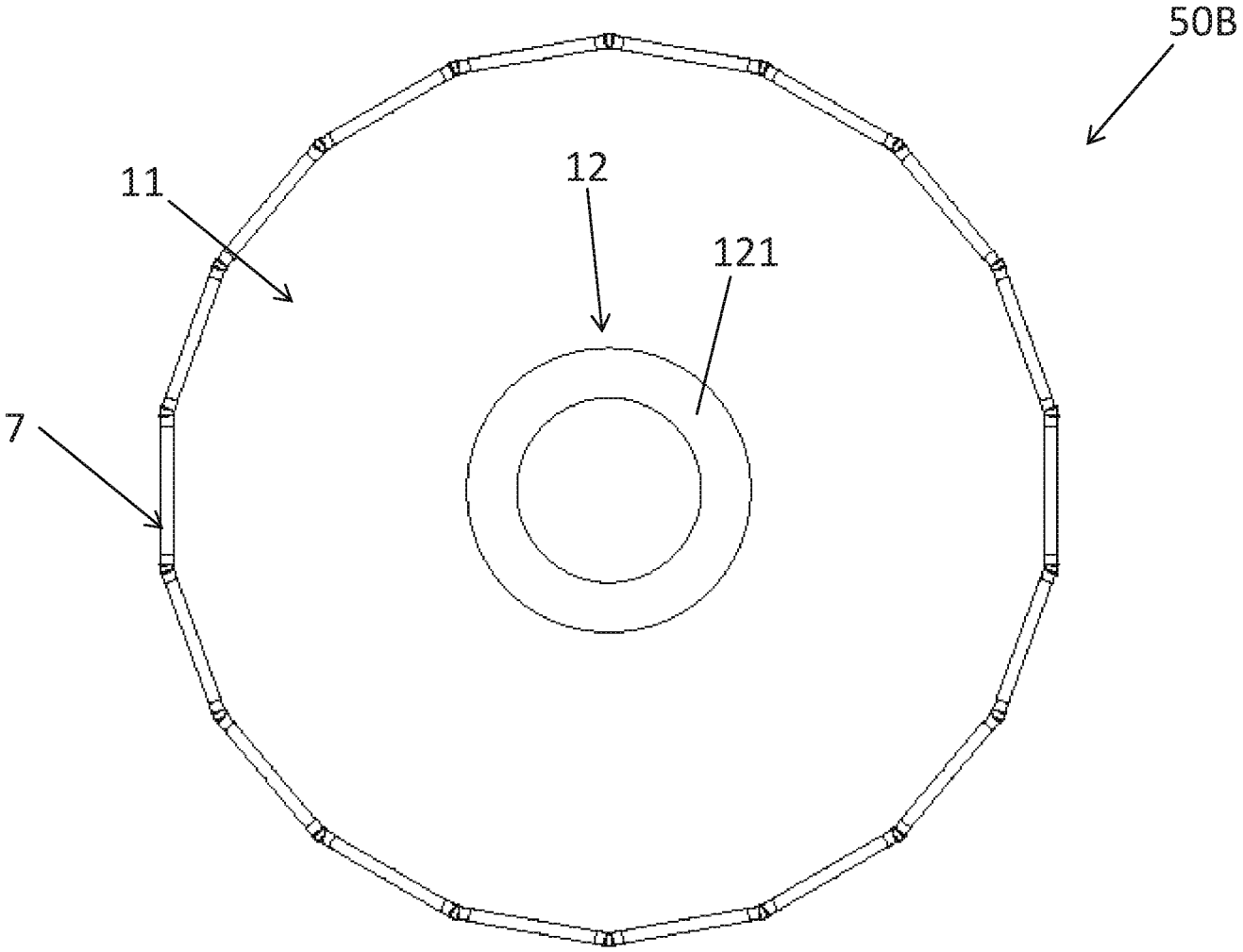
FIG. 5 is a top view of another alternate embodiment of the pool of FIG. 1, in which a circular swimming area is present within the pool.

In the illustrated embodiment, pillar 12 is positioned at the center of inner cavity 7 such that annular lane 11 is symmetrical. However, it is within the scope of the present disclosure that pillar 12 may be positioned elsewhere within inner cavity 7 to define alternative shapes of annular lane 11. FIGS. 1 and 2 show pillar 12 within a generally oval-shaped pool 50, but it is contemplated that in alternate embodiments, pillar 12 may be positioned within a pool that has a different shape such as a rectangle (shown, e.g., as pool 50A with a rectangular annular lane 11 in FIG. 4) or a circle (shown, e.g., as pool 50B with a circular annular lane 11 in FIG. 5). In certain embodiments, pillar 12 and annular lane may have complementary shapes, such as oval-in-oval (FIG. 1) or circle-in-circle (FIG. 5).

Figure 3:
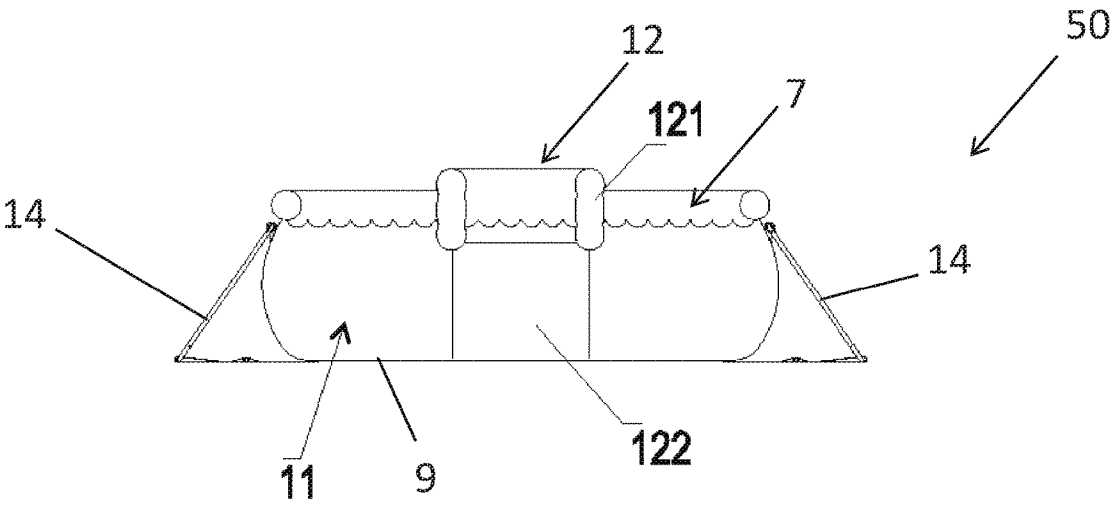
FIG. 3 is a side elevation, cross-sectional view of the pool of FIG. 1 taken along line III-III shown in FIG. 2.

Turning now to FIG. 3, pillar 12 includes a body 121 and connecting straps 122. For purposes of the present disclosure, connecting straps 122 may be sheets which extend along the length of the connected surface, or may be multiple individual straps arranged at intervals along such length. The operation and structure of connecting straps 122 is described for connections between connecting straps 122 and bottom surface 9 of pool body 1, as well as an undersurface of body 121 of pillar 12. It is understood that connection methods and structures described with respect to one surface may also be applied to other surfaces throughout pool 50 as required or desired for a particular application.

Body 121 is connected to the bottom 9 of pool 50 via connecting straps 122 such that when inner cavity 7 is filled with water, body 121 floats on the surface of the water, but substantially remains in position within inner cavity 7 of pool 50 as the connection between the connecting straps 122 and the bottom 9 is tightened due to the buoyancy of body 121. When body 121 is afloat within inner cavity 7, annular lane 11 is formed between wall 5 of pool 50 and the outer surface of body 121 of pillar 12.

In one embodiment, as shown in FIG. 3, body 121 is formed as a smaller pool that is independent from annular lane 11 of pool 50, and can hold its own shallower volume of water. In this configuration, pool 50 comprises two pool areas; adults can swim in the annular lane 11 of pool 50 and children can swim in the shallow pool of body 121 of pillar 12. In an alternate embodiment, body 121 may be a chair or waterbed upon which a user can rest within the pool, thereby allowing the user to relax within pool 50 while removing the need for a user to leave pool 50. In yet another embodiment, body 121 can be (or include) a platform upon which users can place objects (e.g., mobile devices, headphones, drinks, etc.) in order to prevent water from damaging or otherwise affecting the objects. In this embodiment, body 121 also provides for convenience in storage and easy retrieval when necessary as the user need not leave the pool to store and retrieve the object(s).

Figure 6:
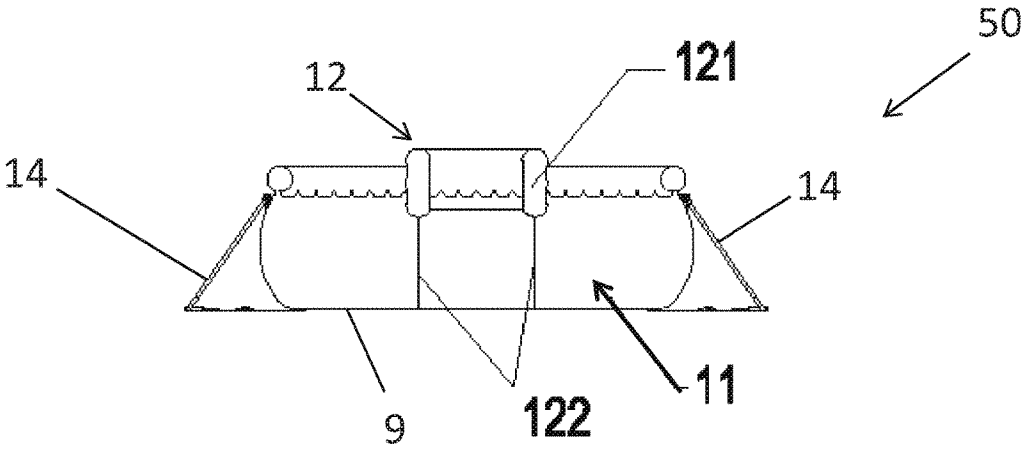
FIG. 6 is an elevation, cross-sectional view of an embodiment of the pool of FIG. 1, illustrating a first arrangement of connecting straps.

Referring now to FIGS. 3 and 6, two connecting straps 122 are used to connect body 121 with bottom 9 of pool body 1. Connecting straps 122 are arranged in parallel at intervals along body 121 with upper ends of connecting straps 122 respectively connected with the various sections of the bottom surface of body 121. The opposing lower ends of connecting straps 122 are respectively connected to various sections or portions of bottom 9 of pool body 1. In an exemplary embodiment shown in FIG. 9, connecting strap 122 has a folded portion at its lower end which is welded to bottom 9 of pool body 1, as shown by the respective shaded areas of FIG. 9. When welded in this manner, connecting strap 122 is not easily removable even during robust use of pool 50, such that the position of pillar 12 is firmly maintained within inner cavity 7 of pool 50.

Figure 7:
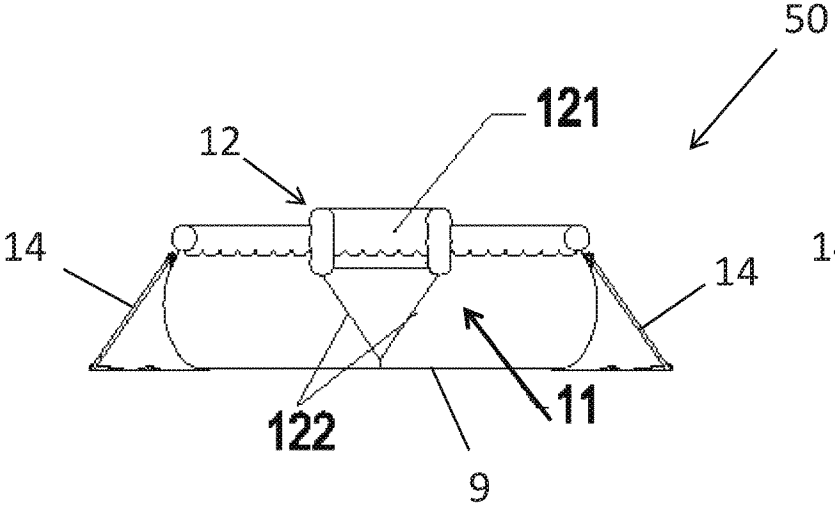
FIG. 7 is an elevation, cross-sectional view of another embodiment of the pool of FIG. 1, illustrating a second arrangement of connecting straps.

In an alternate embodiment, as shown in FIG. 7, connecting straps 122 are arranged in an opposite, inclined pattern with respect to the bottom 9 of pool body 1. In this configuration, the upper ends of the connecting straps 122 are respectively connected to either side of the bottom surface of body 121 of pillar 12, while the lower ends of connecting straps 122 are respectively connected along a central portion of the bottom 9 of pool body 1.

Figure 8:
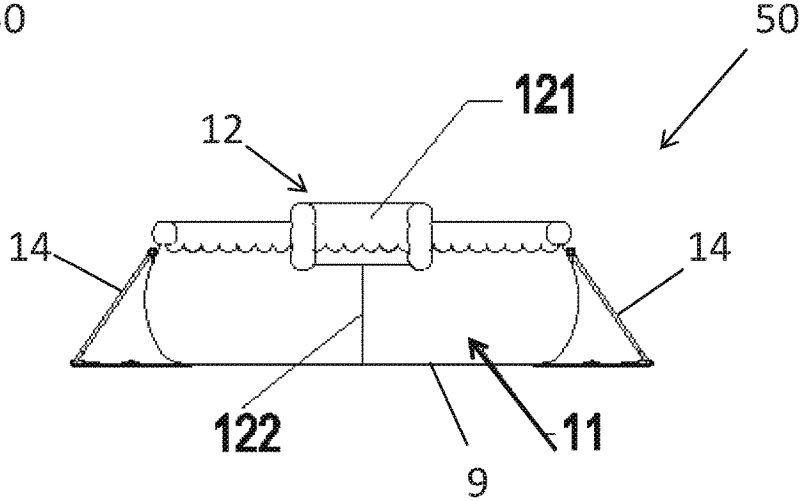
FIG. 8 is an elevation, cross-sectional view of another embodiment of the pool of FIG. 1, illustrating a third arrangement of connecting straps.

In yet another alternate embodiment, as shown in FIG. 8, connecting strap 122 is a single strap or arrangement of straps having its upper end connected to along the central portion of the bottom surface of body 121 and its lower end connected to the central portion of the bottom 9 of pool body 1. Additional alternative configurations for connecting straps 122 may be used to connect body 121 with bottom 9 of pool body 1 and are within the scope of the present disclosure, including combinations of the various configurations described herein.

Figure 9:
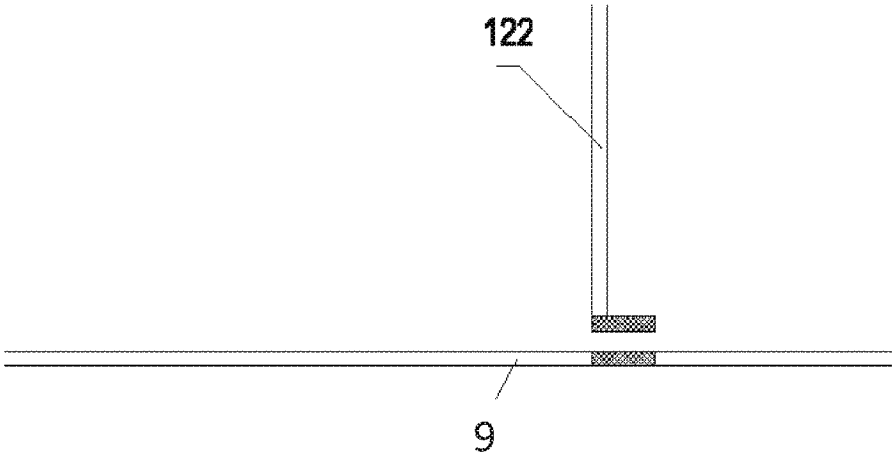
FIG. 9 is a schematic diagram of a connection between a connecting strap and the bottom of the pool.
Figure 24:
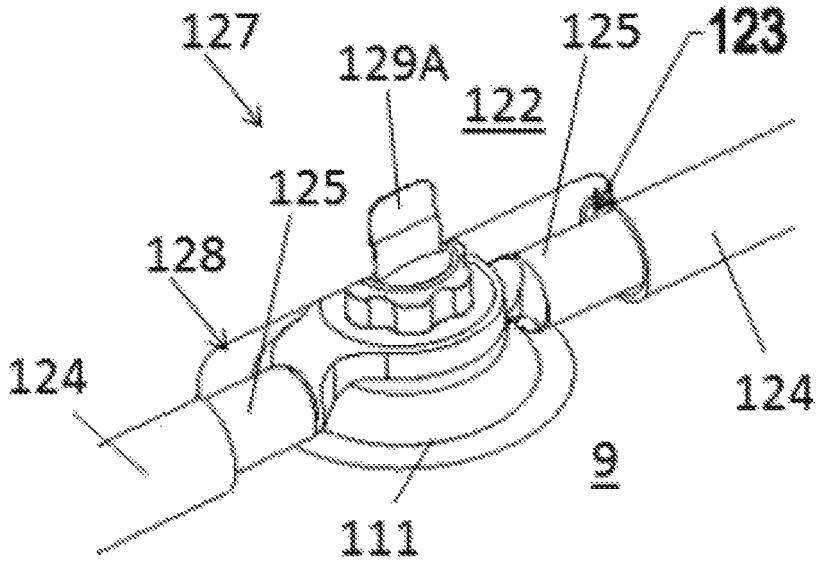
FIG. 24 is a perspective view of a connection between a connecting strap and the bottom of the pool body of a pool body, usable with the pool of FIG. 1.
Figure 25:
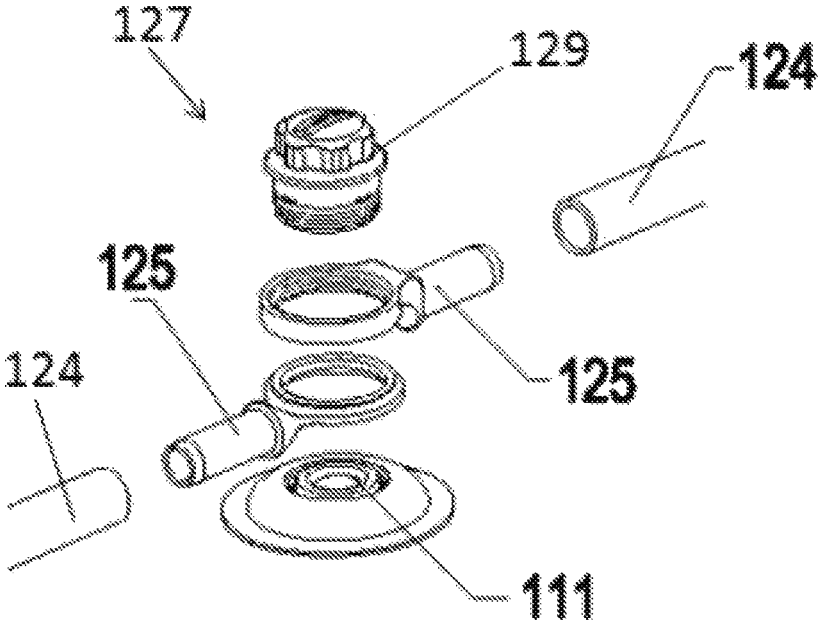
FIG. 25 is an exploded, perspective view of the structure of the connecting strap and the bottom of the pool body shown in FIG. 24.

As an alternative to the welded attachment shown in FIG. 9 and described above, connecting strap 122 can be detachably connected with bottom 9 of pool body 1 as shown in FIGS. 24 and 25. In this arrangement, the bottom of connecting strap 122 includes a hem or similar structure which defines a tubular opening or slot 123. The slot 123 has a longitudinal axis which runs generally parallel to bottom 9 of annular lane 11 and pool body 1. A plurality of gaps 128 interrupt slot 123 at regular intervals. A plurality of horizontal pipes 124 are inserted into respective slots 123 between each neighboring pair of gaps 128, such that a pair of ends of two neighboring horizontal pipes 124 are exposed and face one another in slot 123, as shown in FIG. 24. This pair of ends of the horizontal pipes are connected to one another with mounting studs 125 of connecting apparatus 127 as best seen in FIG. 25.

Connecting apparatus 127 further includes a base 111 with a female thread formed therein, as shown in FIG. 25. The base may be connected to the bottom of pool body 1 and annular lane 11, and within a corresponding one of the slots 123. A nut 129 is passed through correspondingly sized apertures formed in mounting studs 125, as shown in FIG. 25, and threadably engaged with the female thread formed in base 111 to fix studs 125 to bottom 9 of pool body 1 via base 111. An anti-rotation clip 129A may be engaged with nut 129 and connecting sheet 122, as shown in FIG. 24, to inhibit loosening of nut 129 during use of pool 50.

In this way, connecting apparatus is completed and the portion of connecting sheet 122 adjacent to gap 128 is fixed to bottom 9 of pool body 1. The nut 129 may be removed by a reversal of the above-identified steps, such that connecting sheet 122 is also detachable from pool body 1.

Advantageously, in a detachable configuration, a user can detach pillar 12 from bottom 9 of pool body 1 to increase the area of inner cavity 7 thereby increasing the capacity of inner cavity 7 of pool 50. Moreover, such a configuration of connecting strap 122 and bottom 9 increases the flexibility of pool 50 as users can independently decide which configuration of pool 50 to employ.

Figure 26:
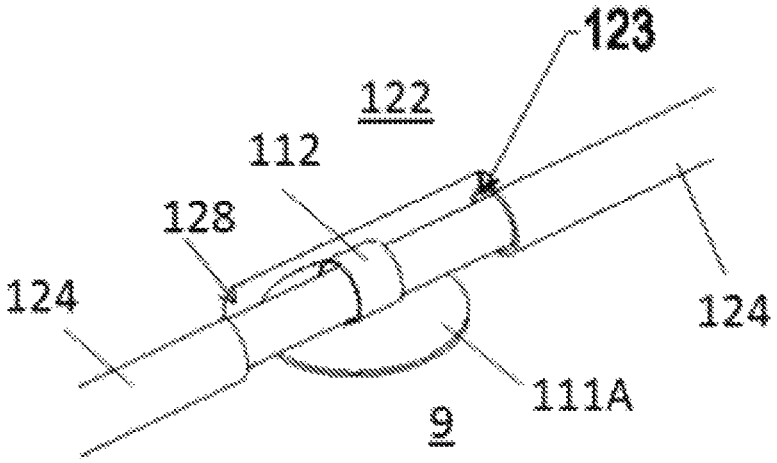
FIG. 26 is a perspective view of an alternate connection between a connecting strap and the bottom of a pool body, usable with the pool of FIG. 1.
Figure 27:
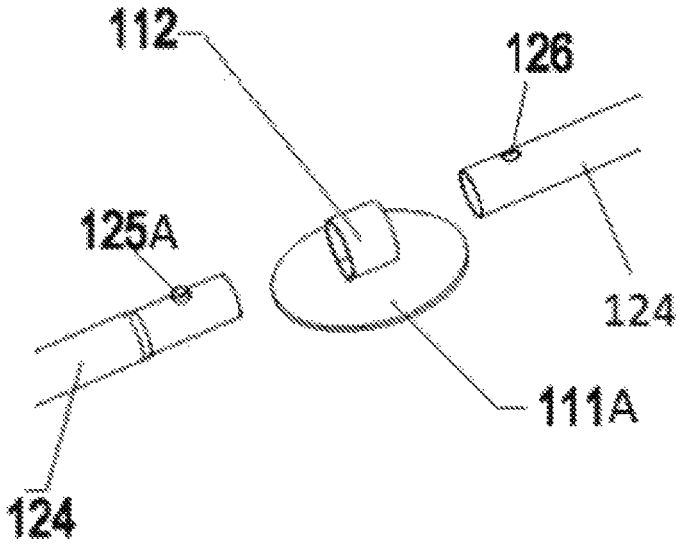
FIG. 27 is an exploded, perspective view of the structure of the connecting strap and the bottom of the pool body shown in FIG. 26.

Turning now to FIGS. 26 and 27, an alternate embodiment of a detachable connector is shown. Similar to the embodiment discussed above with respect to FIGS. 24 and 25, the bottom of connecting strap 122 includes a slot 123 parallel to the bottom 9 of annular lane 11 and pool body 1, a plurality of gaps 128 interrupt slot 123 at regular intervals, and a plurality of horizontal pipes 124 are inserted into slot 123. The horizontal pipes 124 each include a spring loaded detent 125A at one end and an accommodating receiving aperture or divot 126 at the other end. Thus, when two neighboring pipes 124 are brought together at slot 123, detent 125A is received in divot 126 and frictionally engages therewith. Horizontal pipes 124 are thereby connected to each other by inserting detent 125A at one end of horizontal pipe 124 into the female receiving end of another horizontal pipe 124 by depressing and compressing the spring (not shown) of detent 125A. Once detent 125A is engaged with divot 126 of the neighboring horizontal pipe 124, detent 125A is locked into place by rotating horizontal pipe 124 such that detent aligns with the accommodating divot 126 whereby the spring of detent 125A is fully expanded. That is, horizontal pipes 124 are locked with each other when detent 125A of one horizontal pipe 124 is received within divot 126 of another horizontal pipe 124.

Furthermore, a plurality of fixed anchor points 111A are arranged at the bottom of the annular lane 11 at locations corresponding to the various gaps 128. Fixed anchor points 111A have a ring 112 received on a base fixed to bottom surface 9 of pool body 1, such that the longitudinal axis of ring 112 is substantially parallel to bottom 9 of pool body 1. As shown in the assembled configuration of FIG. 26, horizontal pipe 124 passes through ring 112 and connects to another horizontal pipe 124 as described above, such that connecting strap 122 and bottom 9 of pool body 1 are connected.

Figure 28:
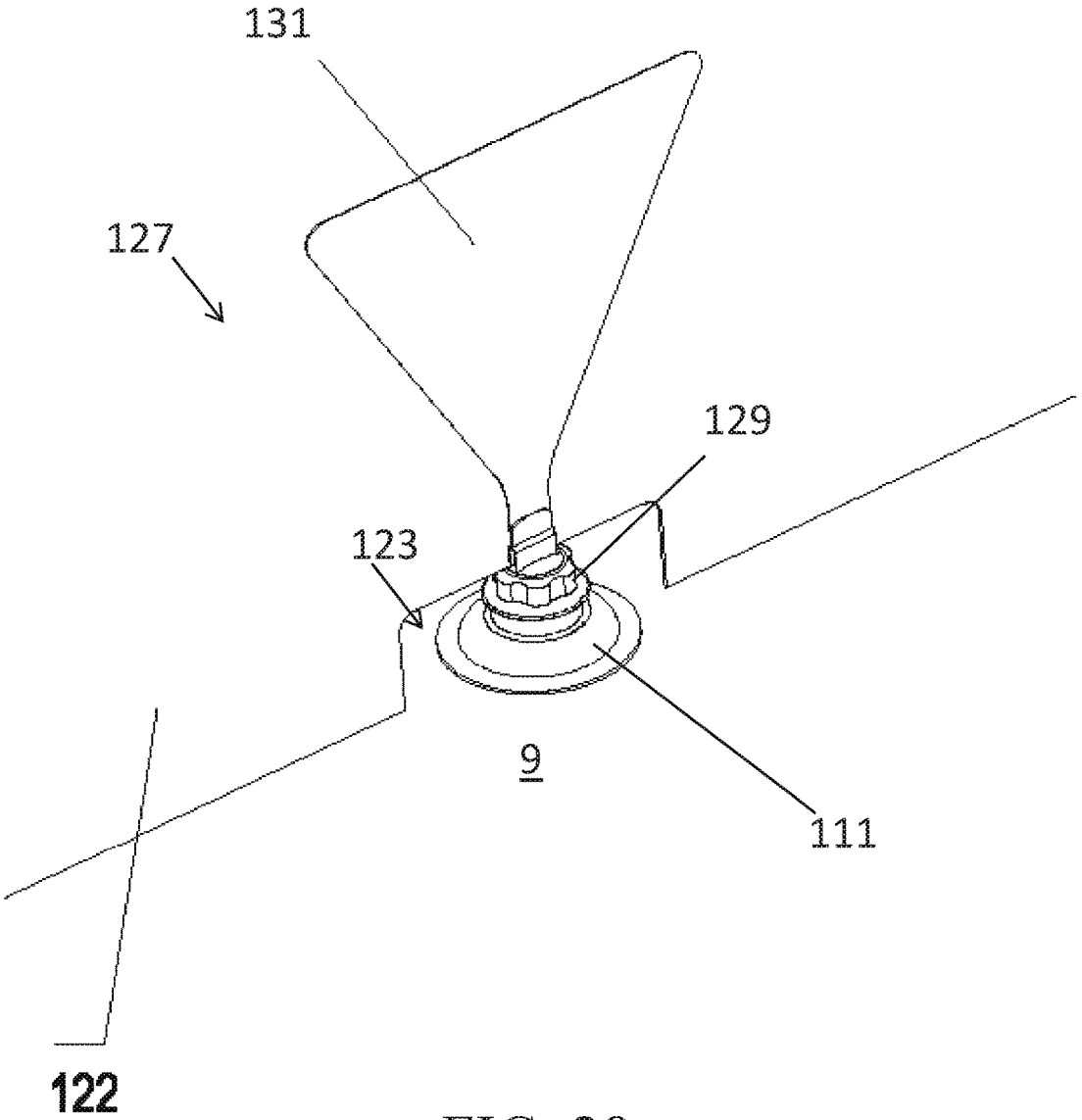
FIG. 28 is a perspective view of an alternate connection between a connecting strap and the bottom of a pool body, usable with the pool of FIG. 1.
Figure 29:
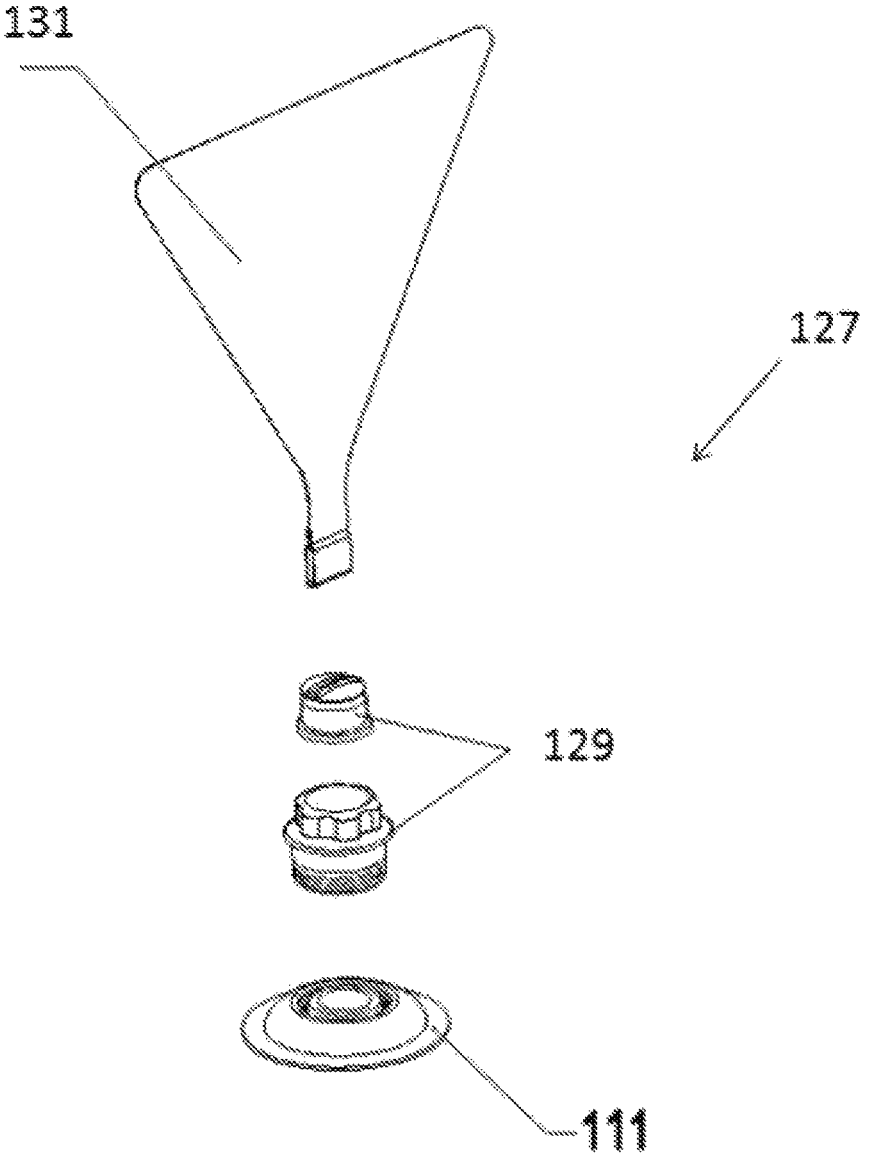
FIG. 29 is an exploded, perspective view of the structure of the connecting strap and the bottom of the pool body shown in FIG. 28.

In a further alternate embodiment, as shown in FIGS. 28 and 29, connecting apparatuses 127 may be used in conjunction with a plurality of tensile sheets 131 arranged on connecting strap 122 toward bottom 9 of pool body 1 and annular lane 11. A lower end of each tensile sheet 131 is coupled to a respective fixing nut 129, while the upper end fans out and forms a more robust connection area for the adjacent connecting apparatus 127. In this way, tensile sheets 131 reinforce the strength and resilience of connecting strap 122 at the point of highest stress, i.e., at the connection with connecting apparatuses 127.

Figure 11:
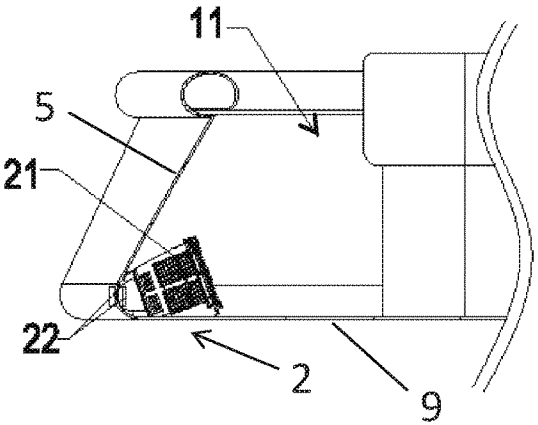
FIG. 11 is an elevation, cross-section view of a portion of the pool of FIG. 1, including a second flow generating arrangement in connection with the pool.
Figure 10:
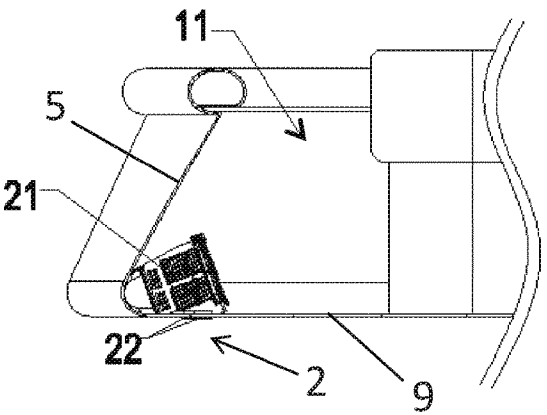
FIG. 10 is an elevation, cross-section view of a portion of the pool of FIG. 1, including a first flow generating arrangement in connection with the pool.

Referring now to FIGS. 10 and 11, pool 50 may include a flow generating device 2 used to drive water in a single direction (e.g., clockwise or counterclockwise) around annular lane 11 and thereby cycle water within annular lane 11 of pool 50. Flow generating device 2 includes a motor 21 positioned in annular lane 11 and a positioning device 22 fixedly connected to motor 21 and wall 5 and/or bottom 9 of pool 50 as described in further detail below.

As shown in FIGS. 10 and 11, the positioning device 22 may include a magnetic element that is fixedly attached to bottom 9 of pool 50, or to both bottom 9 and wall 5 at the connecting corner thereof. In this embodiment, positioning device 22 also includes corresponding a magnetic element or opposite polarity fixedly attached to motor 21, such that motor 21 is installed and retained on the magnetic element on bottom 9 via magnetic attraction. In FIG. 10, one of the magnets of this magnetic positioning device 22 may be disposed under (or embedded in) the bottom surface 9 of pool body 1, while the other may be fixed to a lower surface of motor 21. In FIG. 11, one magnet is disposed outside (or embedded in) wall 5 while the other is fixed to a rearward surface of motor 21.

Figure 12:
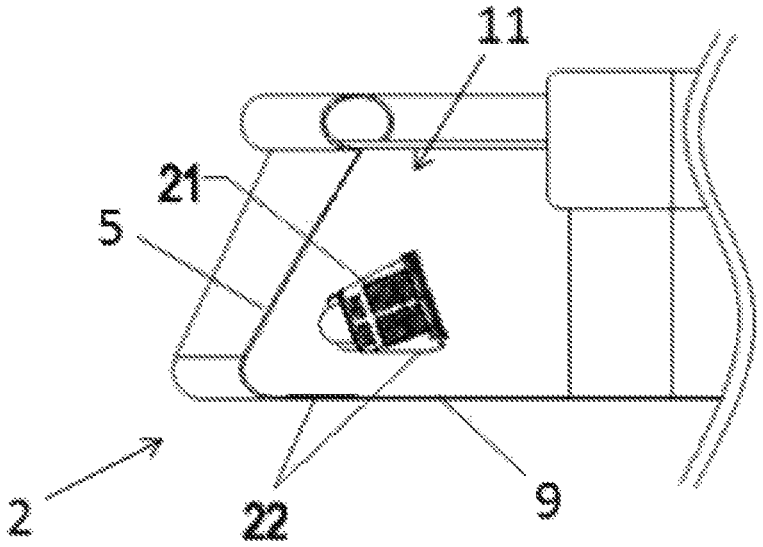
FIG. 12 is an elevation, cross-section view of a portion of the pool of FIG. 1, including a third flow generating arrangement in connection with the pool.

In an alternate embodiment shown in FIG. 12, positioning device 22 includes an adhesive tape or other adhesive material applied to the lower surface of motor 21 and/or the upper surface of bottom 9 in order to connect motor 21 with pool 50.

Figure 13:
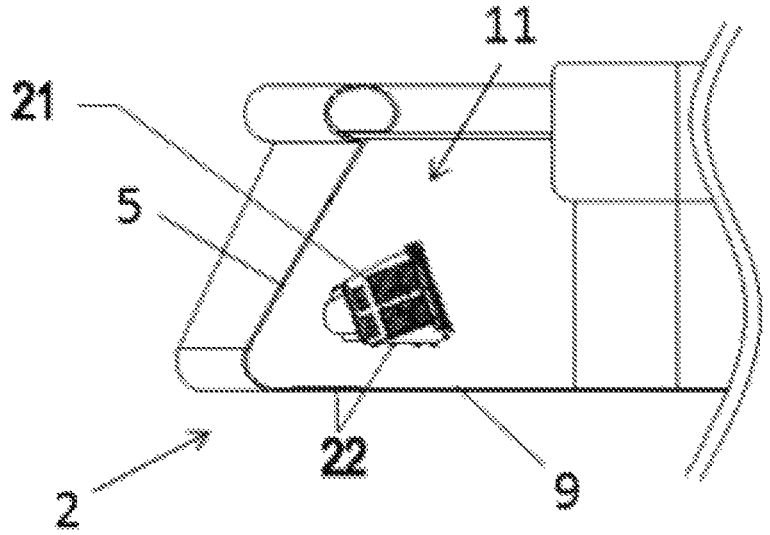
FIG. 13 is an elevation, cross-section view of a portion of the pool of FIG. 1, including a fourth flow generating arrangement in connection with the pool.

In another alternate embodiment shown in FIG. 13, positioning device 22 includes a tensionable strap and a retaining ling, and the bottom portion of motor 21 has the retaining ring connected thereto. Motor 21 is connected to bottom 9 by looping the tensionable strap over the retaining ring and tensioning the strap to retain the retaining ring, and therefore the motor 21, at the location of the strap.

Figure 14:
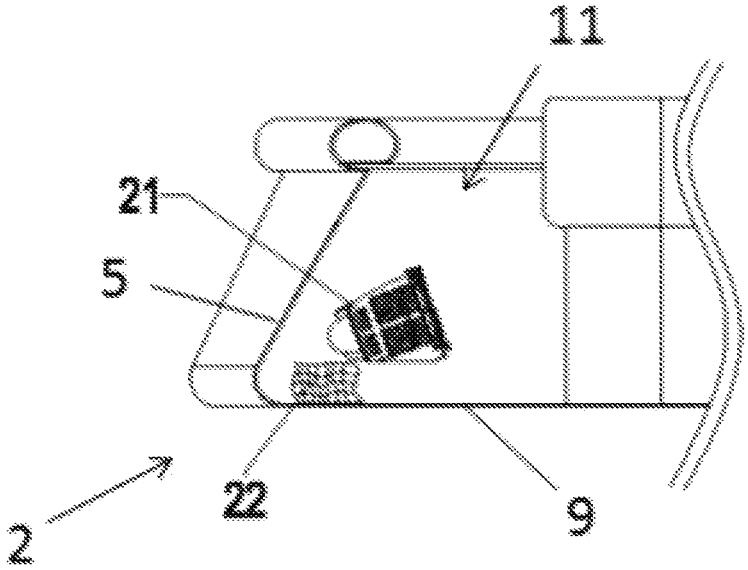
FIG. 14 is an elevation, cross-section view of a portion of the pool of FIG. 1, including a fifth flow generating arrangement in connection with the pool.

In yet another alternate embodiment shown in FIG. 14, positioning device 22 is a porous bag or cover, such as a bag or cover made from netting as illustrated. The motor 21 may be received in the bag and retained therein, such as by closing the bag with a drawstring or other closure. Alternatively, the motor 21 may be trapped by a cover joined directly to the pool body. In either case, the bag or cover restrains motor 21 from moving within annular lane 11, while allowing free flow of water into and out of motor 21 through the bag or cover.

Figure 15:
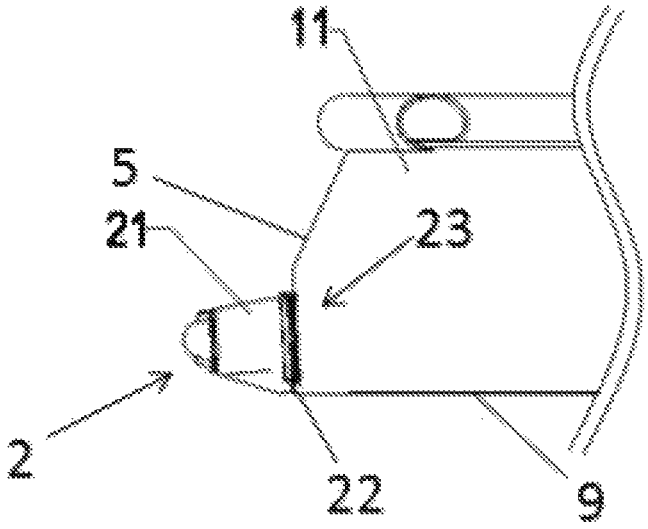
FIG. 15 is an elevation, cross-section view of a portion of the pool of FIG. 1, including a sixth flow generating arrangement in connection with the pool.

In an alternate configuration of pool 50, annular lane 11 of pool 50 includes a dedicated motor cavity 23 arranged on wall 5 of pool body 1 that is sized and configured to receive motor 21. Motor cavity 23 is positioned at an outer periphery of the annular lane 11, such that motor 21 may be positioned outside the primary volume of annular lane 11 and therefore away from the part of annular lane 11 used by swimmers. Motor cavity 23 includes positioning device 22 such that motor 21 is fixed and installed in motor cavity 23 by positioning device 22. In one embodiment, as shown in FIG. 15, positioning device 22 is an adhesive (e.g., glue), and motor 21 is fixedly connected with motor cavity 23 by the adhesive.

Figure 16:
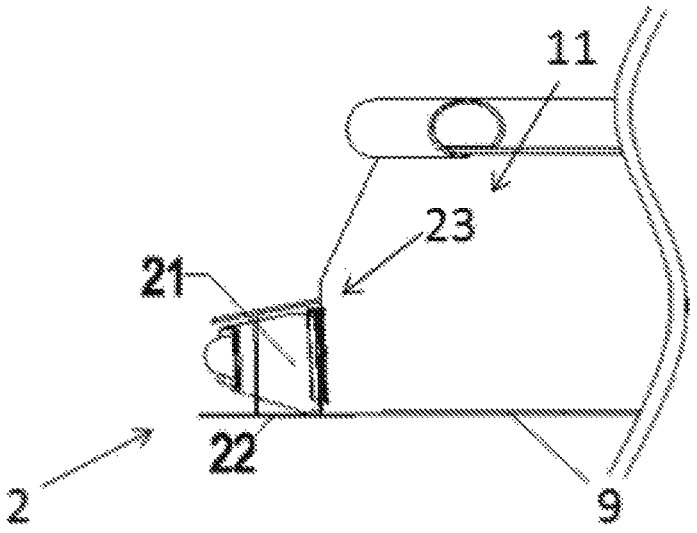
FIG. 16 is an elevation, cross-section view of a portion of the pool of FIG. 1, including a seventh flow generating arrangement in connection with the pool.
Figure 17:
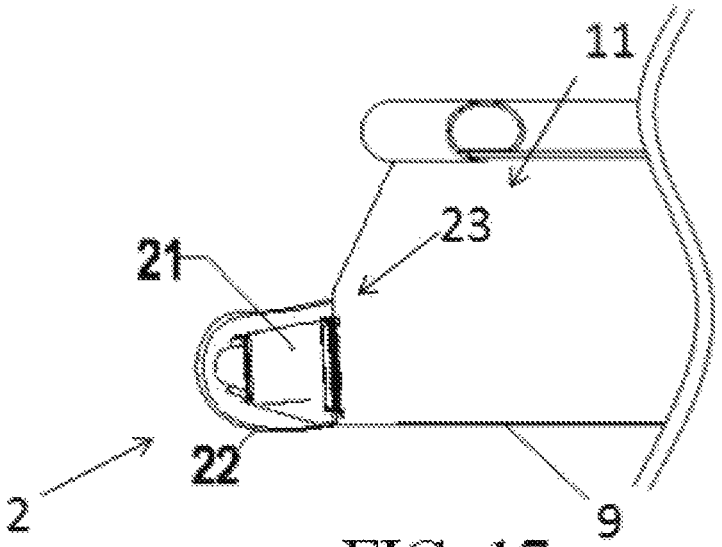
FIG. 17 is an elevation, cross-section view of a portion of the pool of FIG. 1, including a eighth flow generating arrangement in connection with the pool.
Figure 18:
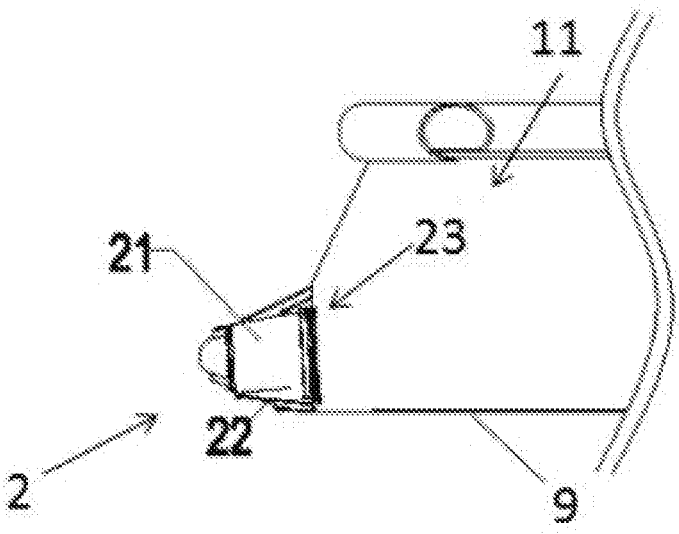
FIG. 18 is an elevation, cross-section view of a portion of the pool of FIG. 1, including a ninth flow generating arrangement in connection with the pool.

In an alternate embodiment, as shown in FIGS. 16-18, positioning device 22 is a frame (FIG. 16), bag (FIG. 17), or a tensionable strap (FIG. 18) fixedly connected with motor cavity 23 in similar fashion to positioning devices 22 described above in connection with the embodiments of FIGS. 10-14. Alternate positioning devices 22 within motor cavity 23 may be employed as required or desired for a particular application, and are within the scope of the present disclosure.

Figure 19:
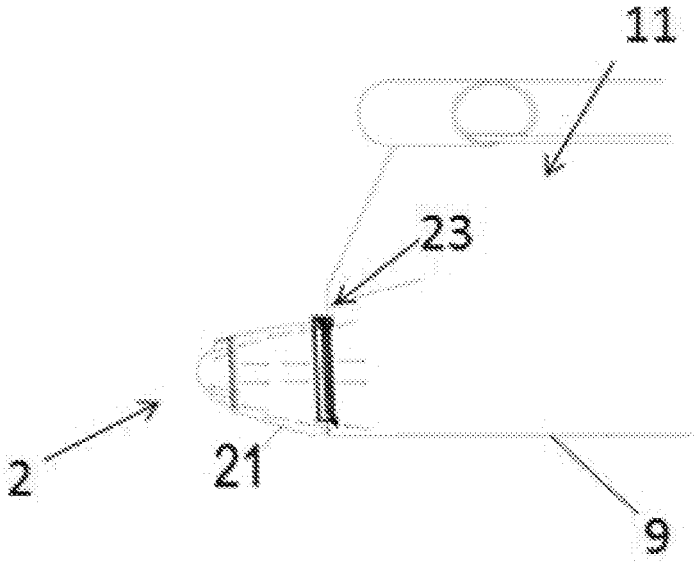
FIG. 19 is an elevation, cross-section view of a portion of the pool of FIG. 1, including a first waterway arrangement for a flow generator used in connection with the pool.

During operation of flow generating device 2, an output water flow is directed from motor 21 into annular lane 11 along a generally central, longitudinal axis of motor 21, which is also the axis of rotation for the motor's impeller. The corresponding input water flow is drawn from peripheral openings formed in and/or around motor 21, such as radially outside the impeller's outer diameter as shown in FIG. 19.

Figure 20:
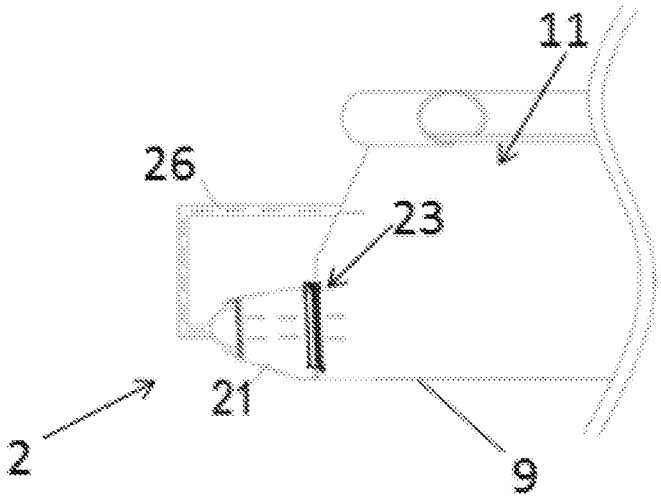
FIG. 20 is an elevation, cross-section view of a portion of the pool of FIG. 1, including a first waterway arrangement for a flow generator used in connection with the pool.

In an alternate embodiment, as shown in FIG. 20, one end of the motor 21 (i.e., the end that is spaced away from annular lane 11 and deep within motor cavity 23) has a water flow connection to annular lane 11 via water pipe 26. In the illustrative embodiment, an input flow of water is directed to motor 21 via water pipe 26, and motor 21 then directs an output water flow back to annular lane 11 from cavity 23, along the longitudinal axis of motor 21. Alternatively, motor 21 may be reversed such that an input water flow is received directly from annular lane 11 into cavity 23, and the output water flow is directed back into annular lane 11 via water pipe 26. In some design configurations, outlet water flows from motor 21 are not substantially coaxial with the longitudinal axis of motor 21. For this, outlet water flows may be rectified by a fairing 215 as discussed further herein.

Figure 22:
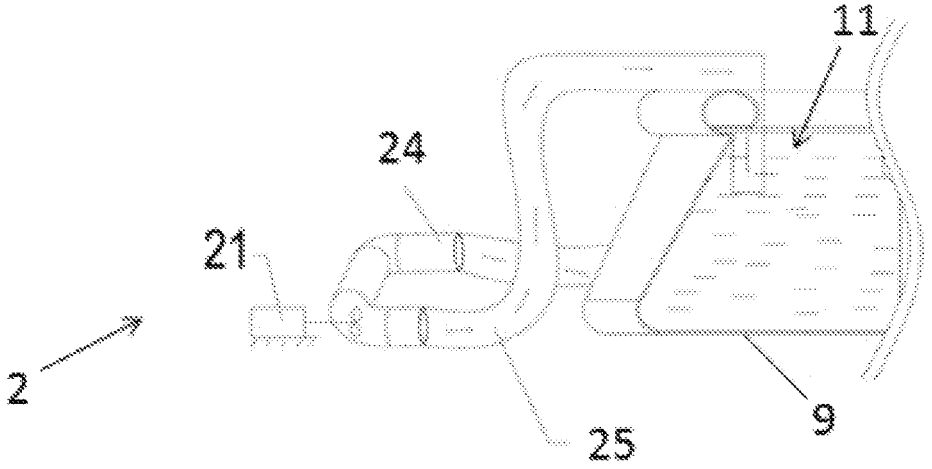
FIG. 22 is a schematic diagram of a flow path for a flow generating device and corresponding motor in connection with the pool of FIG. 1.
Figure 23:
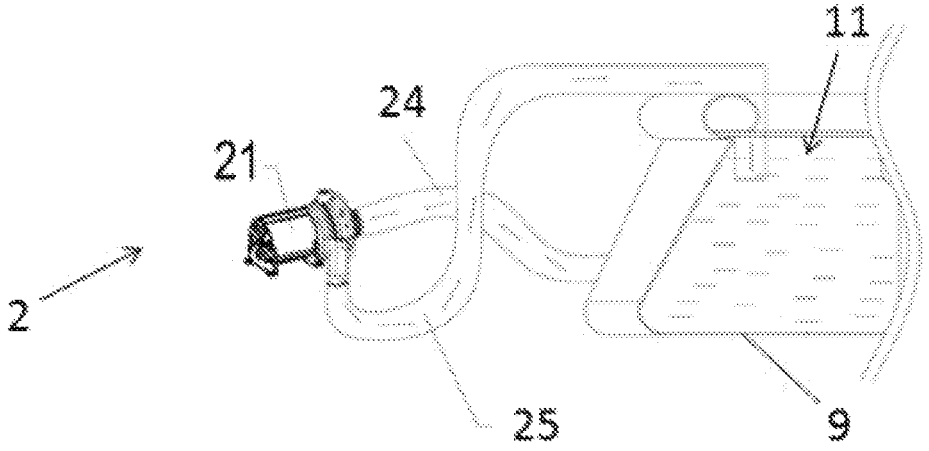
FIG. 23 is a schematic diagram of an alternate flow path for a flow generating device and corresponding motor in connection with the pool of FIG. 1.

In an alternate configuration of pool 50, flow generating device 2 may be placed outside pool body 1 as shown in FIGS. 22 and 23. Water inlet pipe 24 and outlet pipe 25 are operably connected between annular lane 11 and motor 21 such that water flows from annular lane 11, into water inlet pipe 24 by motor 21, and returns to annular lane 11 via outlet pipe 25 after passing through motor 21. In an exemplary embodiment, motor 21 may be a centrifugal pump, as shown in FIG. 22, or an axial pump, as shown in FIG. 23.

Figure 21:
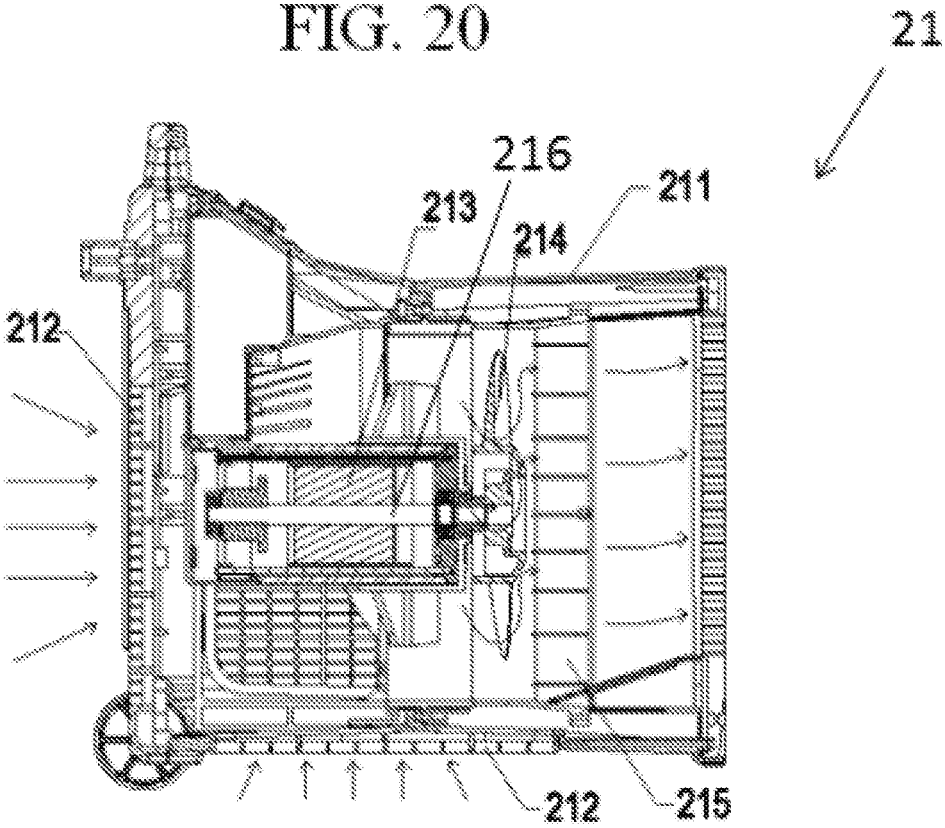
FIG. 21 is an elevation, cross sectional view of a flow generating device used in connection with the pool of FIG. 1.

An exemplary motor 21 is shown in FIG. 21. Motor 21 includes a cover 211 where the bottom surface of cover 211 and the side of cover 211 each include a water inlet 212. When used in connection with motor cavity 23 of pool body 1, the bottom surface of cover 211 and the side of cover 211 are oriented toward motor cavity 23. Motor 21 further includes a single-phase motor 213 within cover 211 where output shaft 216 of single-phase motor 213 is connected with an impeller or blade 214. Adjacent impeller 214, a fairing 215 is installed. In general, inlet water flows are received by motor 21 via water inlets 212, while outlet flows are passed through fairing 215 in order to direct the outlet flows along the desired direction (e.g., coaxial with the longitudinal axis of motor 21. For purposes of the present disclosure, this orientation of the outlet water flow is referred to as rectification.

Referring now to FIGS. 30-40, flow generating device 2 may include a hanging device 30 in addition to motor 21. Hanging device 30 includes a hanging member assembly 3 with a hooked upper end configured to be hung from the edge of pool 50, as well as a mounting assembly 4 connected to hanging member assembly 3 for the installation and support of motor 21, as further described in detail below.

Mounting assembly 4 includes a main body 41 and an angle adjustment mechanism 42. One side of main body 41 faces inner cavity 7 of pool 50 and is fixedly connected to motor 21. The other side of the main body 41 faces wall 5 of pool body 1 and is connected thereto via angle adjustment mechanism 42.

Angle adjustment mechanism 42 includes an abutting block 421, which abuts and wall 5 of pool body 1, and may optionally be connected and/or affixed thereto. When the abutting block 421 is positioned against wall 5, wall 5 provides a support force to abutting block 421. When flowing water impacts motor 21, the support force of wall 5 balances the impact force applied by the flowing water and prevents motor 21 from shaking in the pool. That is, abutting block 421 and wall 5 cooperate to enhance the stability of motor 21 during operation. A soft rubber pad 424 is further arranged on the side of abutting block 421 toward wall 5 of pool 50 such that soft rubber pad 424 prevents a large impact force of flowing water from damaging wall 5 of pool 50. Furthermore, soft rubber pad 424 is deformable such that it can match the thickness of wall 5 to provide a more uniform appearance of pool 50.

Angle adjustment mechanism 42 further comprises a reversing mechanism 422 which is configured to transform a movement parallel to body 41 into a movement perpendicular to body 41. Reversing mechanism 422 comprises a screw rod 4221, a screw arbor 4222 threadably engaged with screw rod 4221, a first connecting rod 4223, and a second connecting rod 4224. One end of the first connecting rod 4223 is linked to screw arbor 4222, and one end of the second connecting rod 4244 is rotatably connected to main body 41. The other end of the first connecting rod 4223 is hinged to the other end of the second connecting rod 4224, and this hinge is connected with the abutting block 421.

Figure 32:
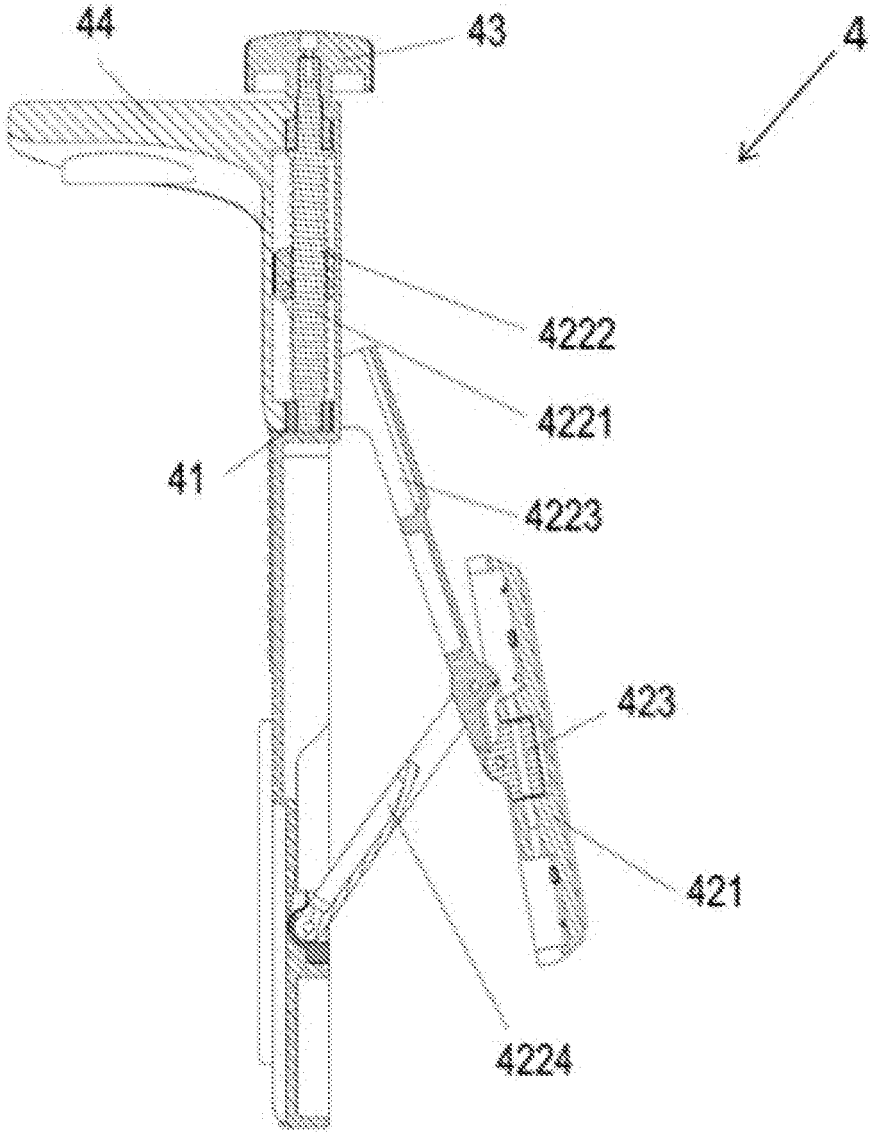
FIG. 32 is an elevation, cross sectional view of the mounting member of the motor hanging device of FIG. 30, shown in an open configuration with an abutting block extended.
Figure 33:
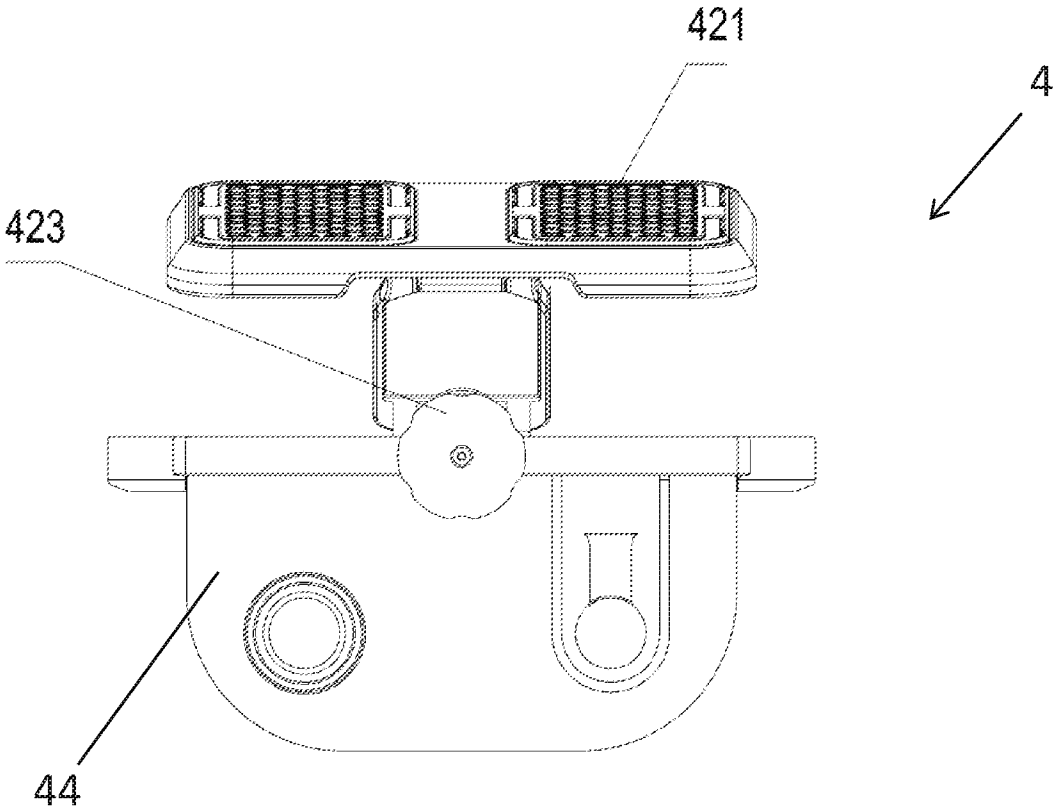
FIG. 33 is a perspective view of an angle adjusting device of an abutting block in accordance with the present disclosure shown in a first angular configuration.
Figure 34:
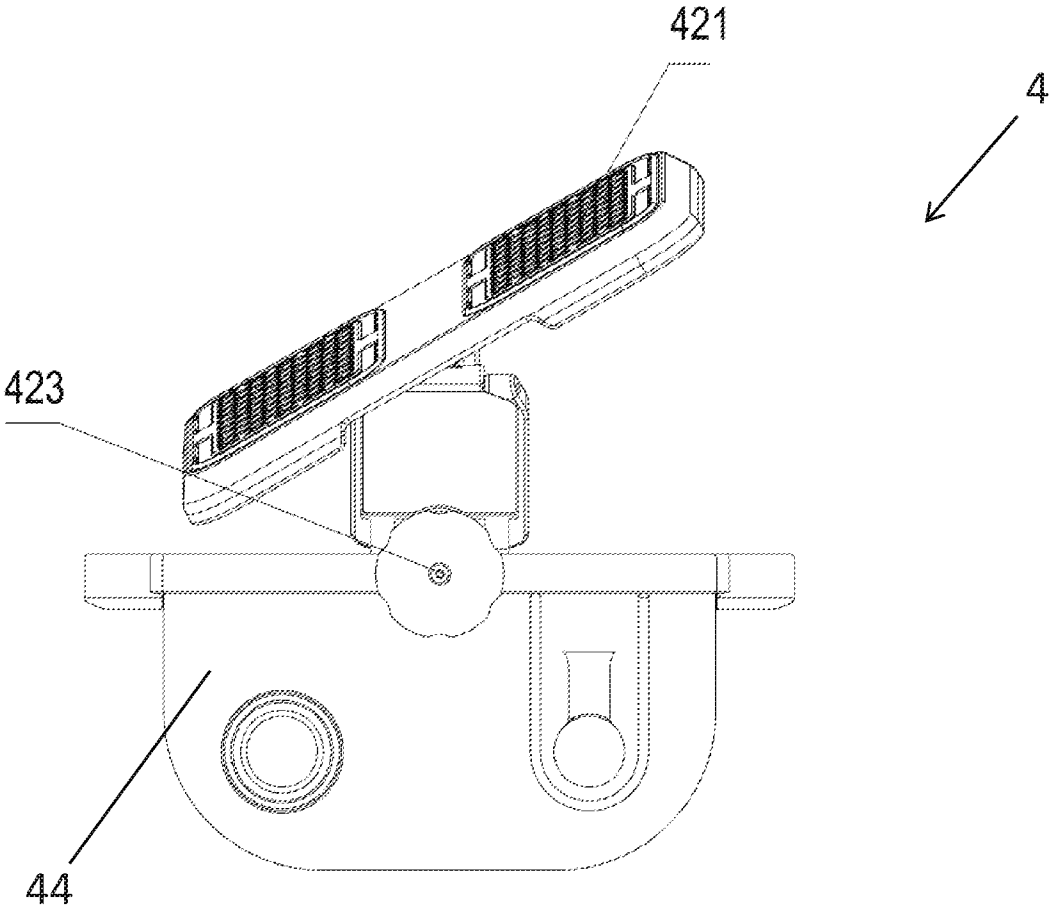
FIG. 34 is a perspective view of an angle adjusting device of an abutting block in accordance with the present disclosure shown in a second angular configuration.
Figure 35:
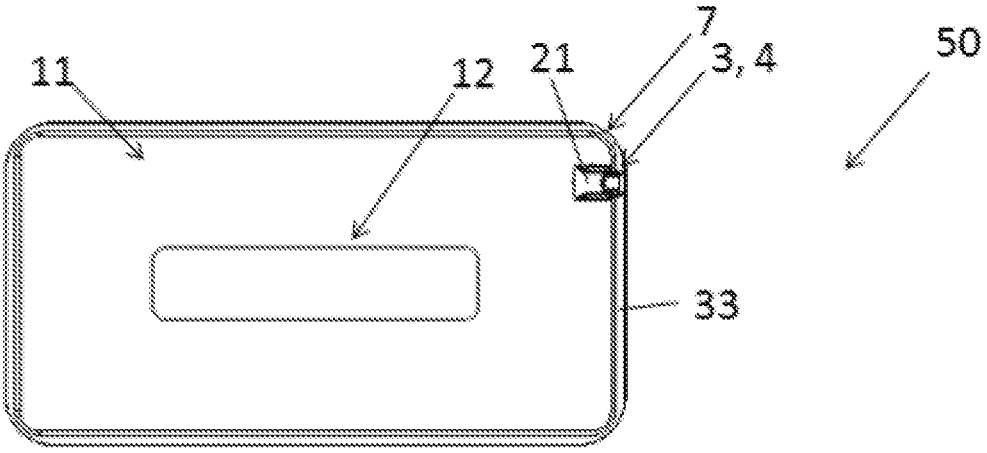
FIG. 35 is a top plan view of a rectangular pool having the hanging device of FIG. 30 suspended on an edge thereof.
Figure 35A:
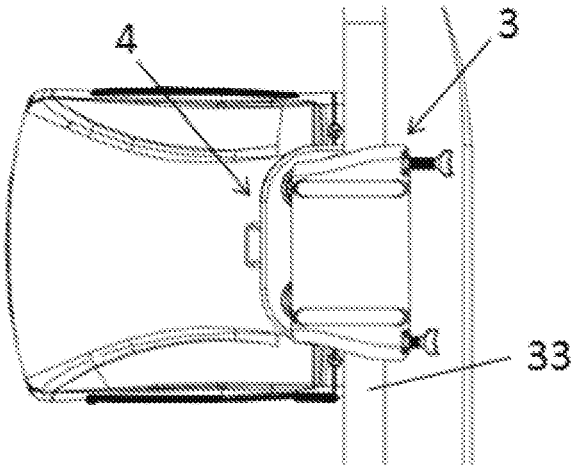
FIG. 35A is an enlarged view of a portion of FIG. 35, illustrating the hanging device.

As screw rod 4221 rotates (e.g., under a rotational force applied to handle 43), screw arbor 4222 moves along the axial direction of screw rod 4221 and drives the movement and articulation of first connecting rod 4223 between a contracted configuration (shown in FIG. 31) and an expanded configuration (shown in FIG. 32). Because one end of second connecting rod 4224 is connected to main body 41 which is axially fixed relative to screw rod 4221, second connecting rod 4224 will not move with the axial movement of screw arbor 4222. Therefore, the intersection angle of first connecting rod 4223 and second connecting rod 4224 changes to push the abutting block 421 to move relative to wall 5 of pool 50. This pushing configuration is shown, e.g., in FIGS. 35A and 36A in which the expanded configuration of mounting assembly 4 has engaged abutting block 421 against the adjacent wall 5.

Figure 37:
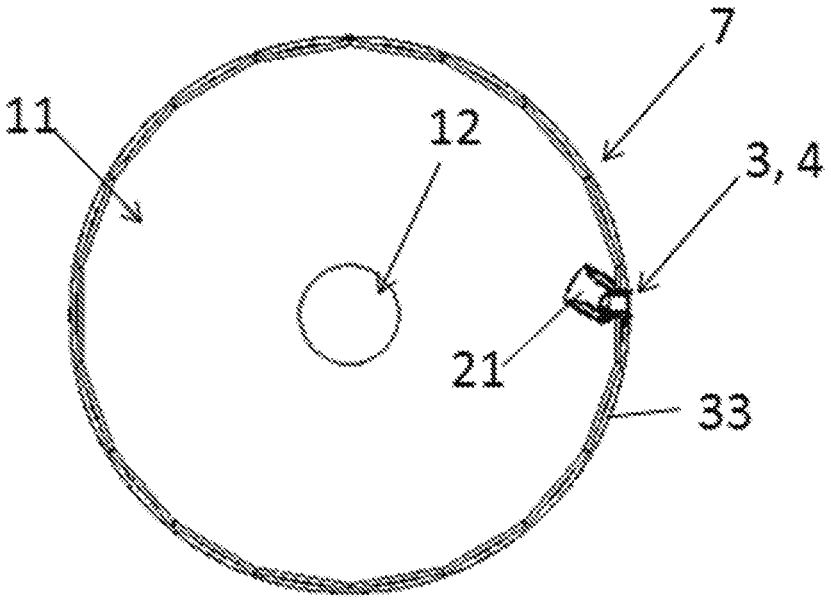
FIG. 37 is a top plan view of a circular pool having the hanging device of FIG. 30 suspended on an edge thereof.
Figure 37A:
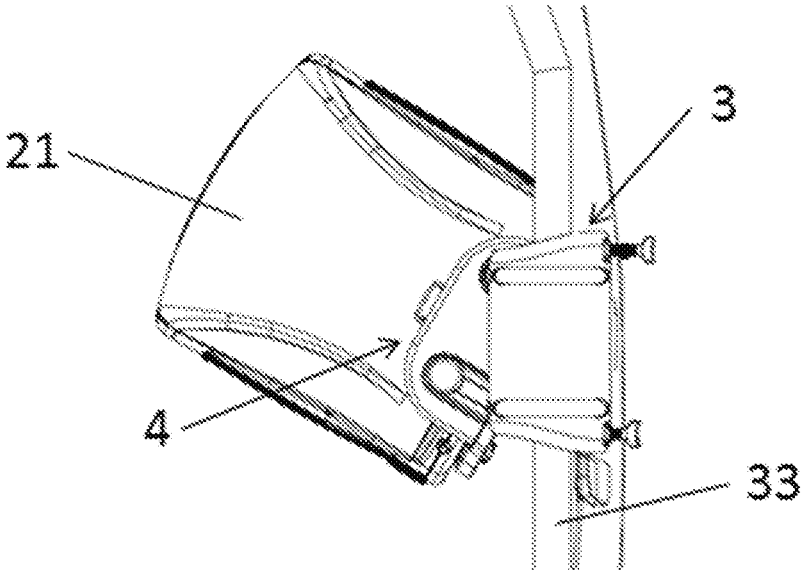
FIG. 37A is an enlarged view of a portion of FIG. 37, illustrating the hanging device.
Figure 38:
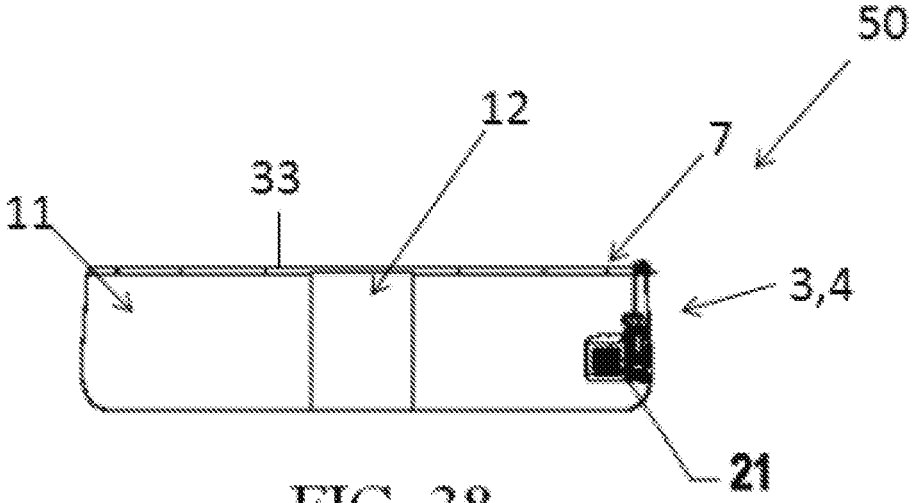
FIG. 38 is a side elevation view of the circular pool of FIG. 37, showing the hanging device of FIG. 30 suspended on the edge thereof.
Figure 38A:
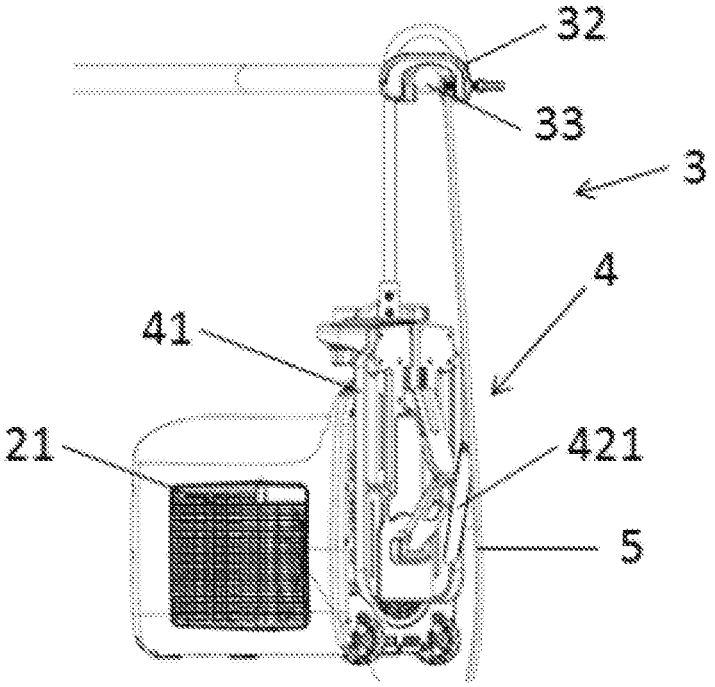
FIG. 38A is an enlarged view of a portion of FIG. 38, illustrating the hanging device.
Figure 39:
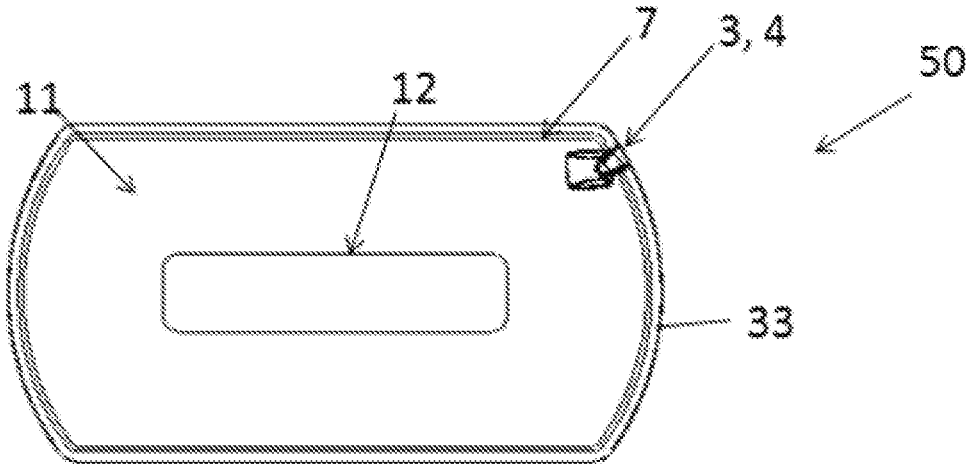
FIG. 39 is a top plan view of a lane-shaped pool having the hanging device of FIG. 30 suspended on an edge thereof.
Figure 39A:
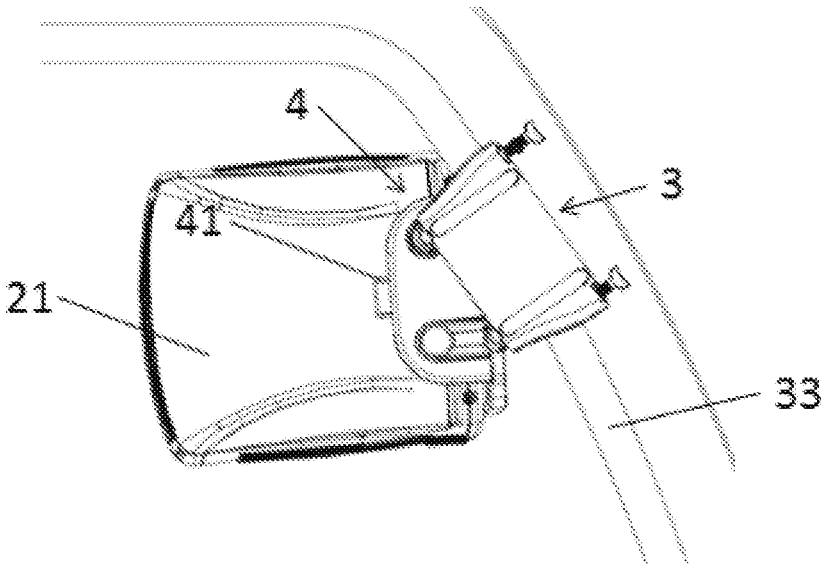
FIG. 39A is an enlarged view of a portion of FIG. 39, illustrating the hanging device.
Figure 40:
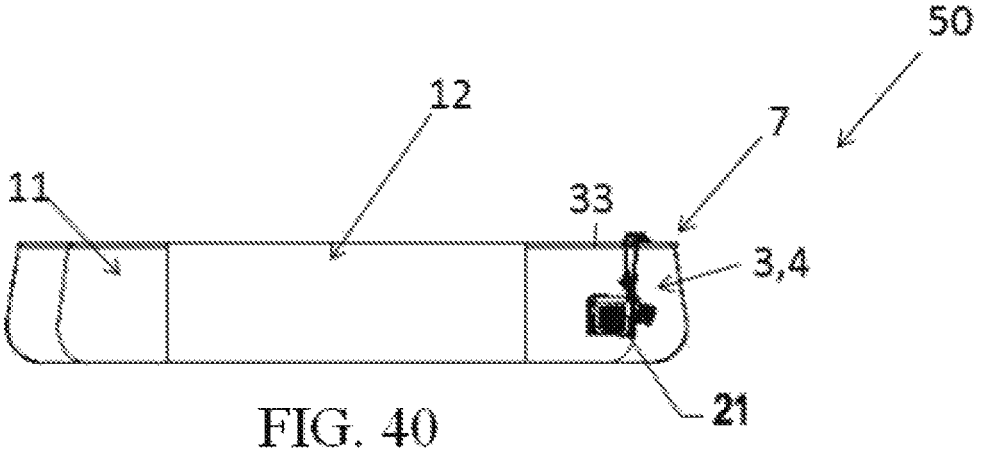
FIG. 40 is a side elevation view of the lane-shaped pool of FIG. 39, showing the hanging device of FIG. 30 suspended on the edge thereof.
Figure 40A:
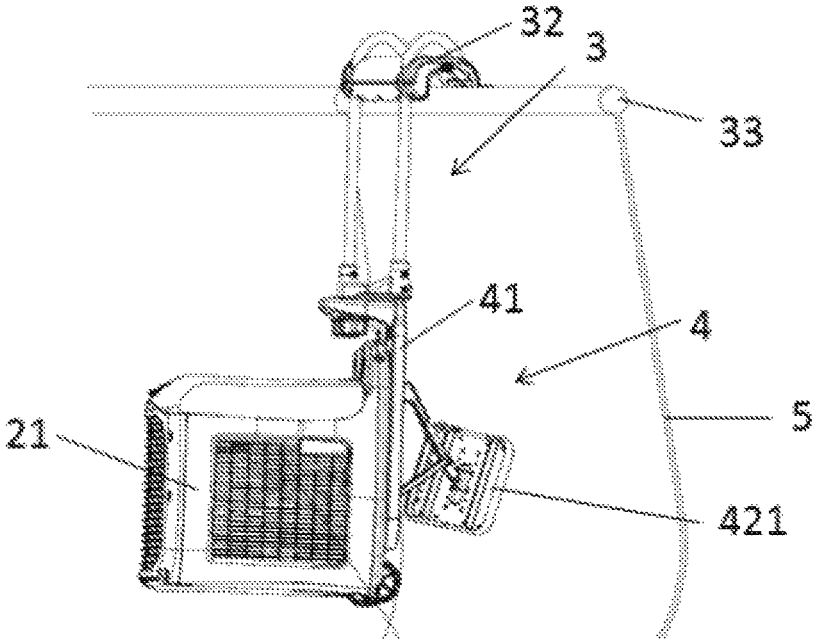
FIG. 40A is an enlarged view of a portion of FIG. 40, illustrating the hanging device.

When the abutting block 421 presses against wall 5 of pool 50, screw rod 4221 will not rotate further. The hinged ends of first connecting rod 4223 and second connecting rod 4224 are connected to abutting block 421 through a universal ball joint 423, best shown in FIGS. 33 and 34. Because walls 5 of pools 50 vary, the abutting area must be large and the clearance between the abutting block 421 and wall 5 needs to be small to ensure that the abutting block 421 can tightly conform to the wall of pool 50. The universal ball joint 423 can automatically adjust the direction and orientation of the abutting block 421 according to the direction of the force applied by the abutting block 421 onto wall 5 of pool 50, ensuring tight conformity. For example, FIGS. 37A and 38A illustrate use of mounting assembly 4 on a circular wall, in which ball joint 423 has enabled substantial skewing of abutting block 421 relative to its centered position. Another example of such an installation is shown in FIGS. 39-40A.

Main body 41 includes an accommodating groove 411 along the longitudinal direction of main body 41. Screw rod 4221 and screw arbor 4222 are positioned within accommodating groove 411, and the upper end of screw rod 4221 is exposed from the top end face of main body 41 through the accommodating groove 411. An adjusting nut or handle 43, which is rotatably connected with screw rod 4221, drives the rotation of screw rod 4221, which controls the movement of abutting block 421 as described above. Therefore, the adjusting process is intuitive and easily ascertained by the user.

Figure 30:
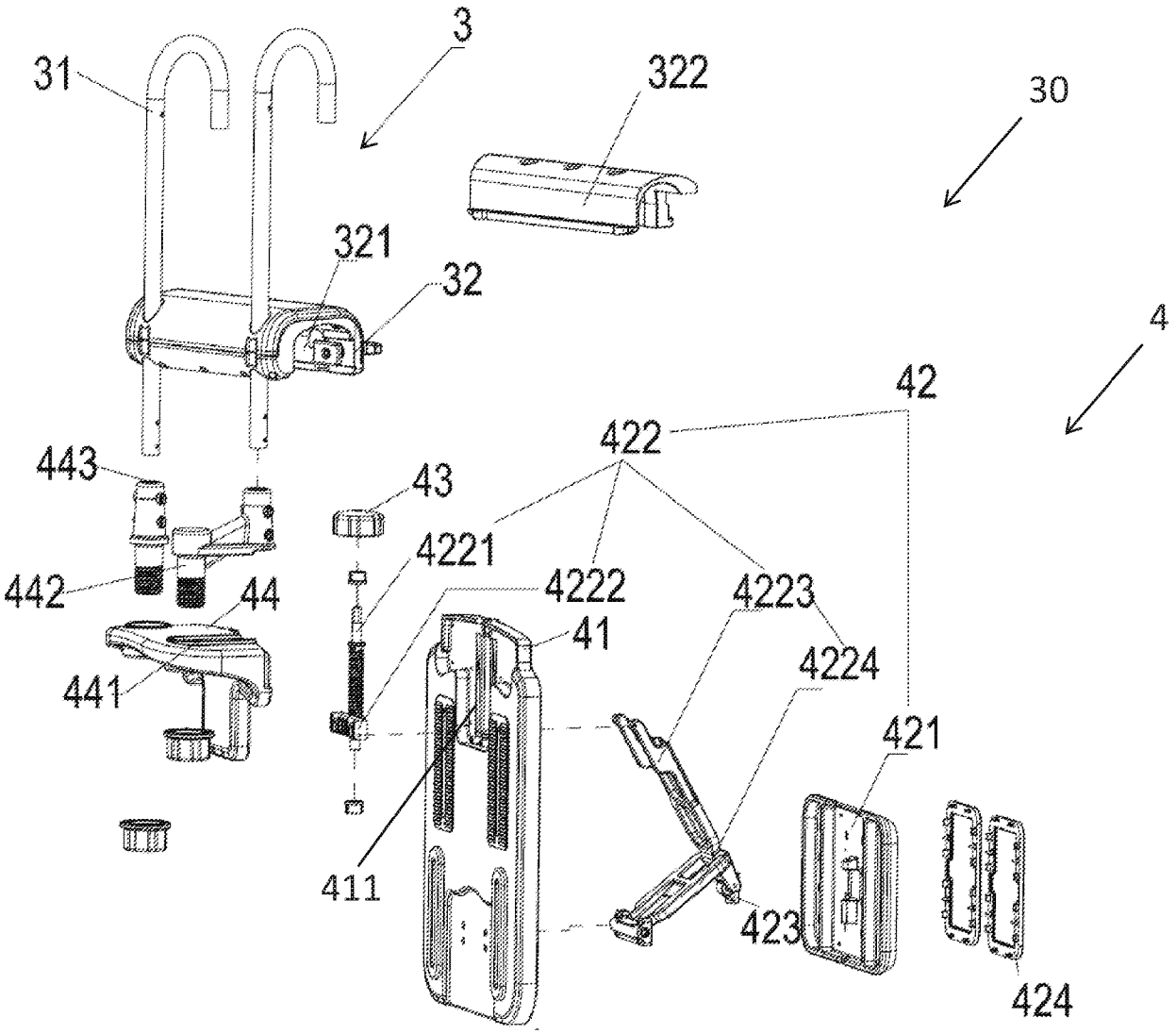
FIG. 30 is an exploded view of the structure of a motor hanging device in accordance with the present disclosure.
Figure 31:
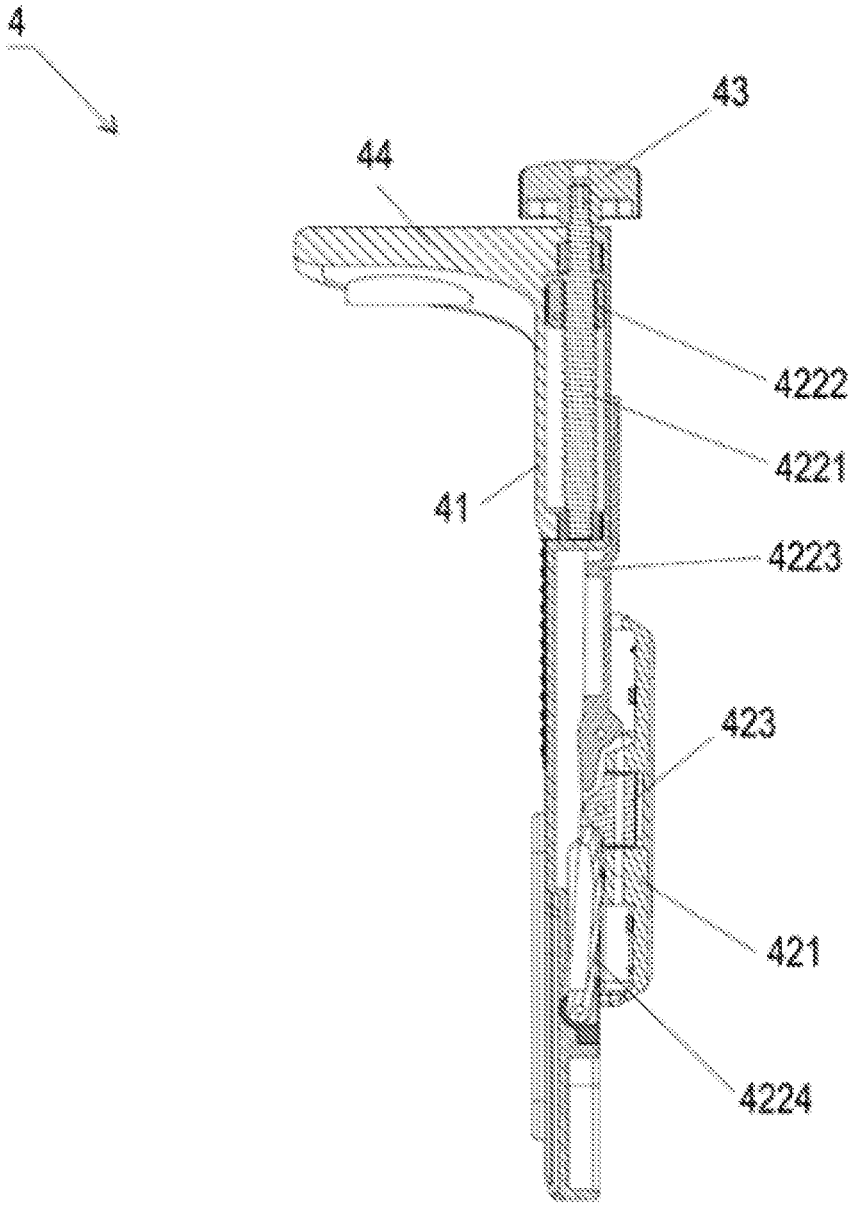
FIG. 31 is an elevation, cross sectional view of the assembled mounting member of the motor hanging device of FIG. 30, shown in a closed configuration.

The top end surface of main body 41 extends with a platform 44 along the water storage space of pool 50. Platform 44 includes a through groove 441 with a connector 442 positioned within groove 441. Connector 442 includes a slot 443 extending in a vertical direction along connector 442. As shown in FIG. 30, there are three slots or bores 443 arranged in a triangular pattern. One of slots 443 is a common slot while the other two are function slots configured for use in different shapes of pools.

Hanging member assembly 3 includes two vertical rods 31 which are parallel to each other. A lower end of each vertical rod 31 is inserted into one of two slots 443 and locked by nuts, while the upper end of vertical rods 31 is bent in a hook like pattern. During assembly, one of the vertical rods 31 is inserted into the common slot 443 while the other vertical rod 31 is inserted into the corresponding function slot 443 depending on the shape of pool 50. For example, when pool 50 is rectangular, the other vertical rod 31 connects to the function slot 443 close to the storage space (not shown) of pool 50. When the edge of the pool is arc-shaped, the other vertical rod 31 connects to the function slot 443 closer to the wall 5 of pool 50.

Figure 36:
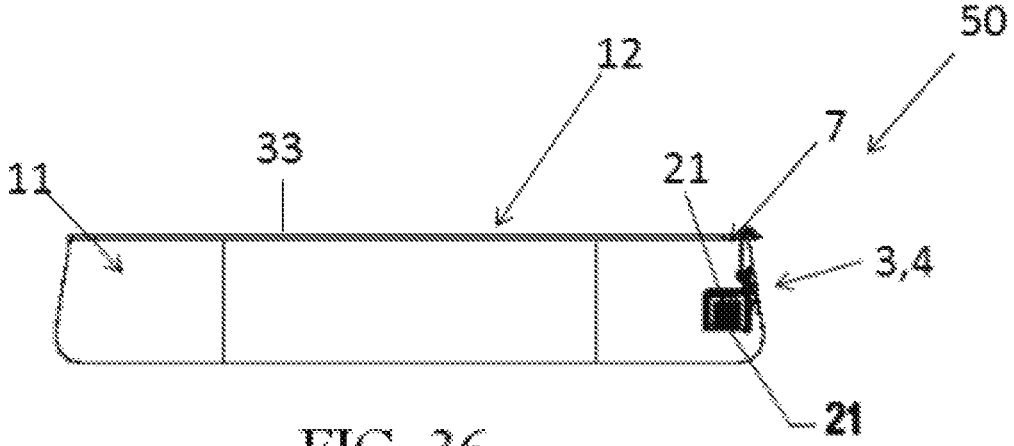
FIG. 36 is a side elevation view of the rectangular pool of FIG. 35, showing the hanging device of FIG. 30 suspended on the edge thereof.
Figure 36A:
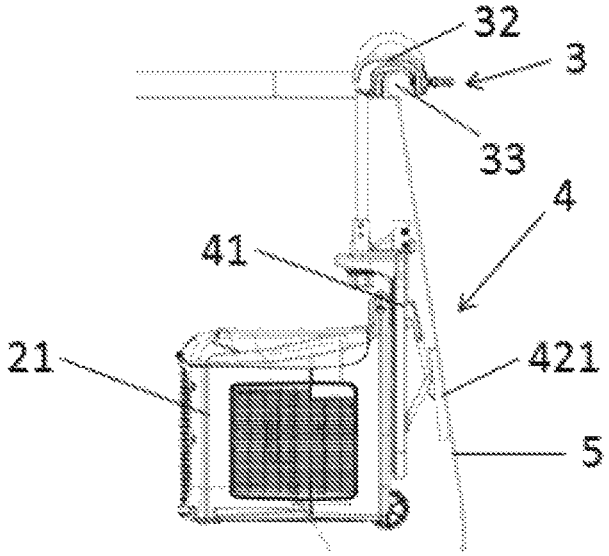
FIG. 36A is an enlarged view of a portion of FIG. 36, illustrating the hanging device.

A locking connection member 32 passes through the hook pattern of vertical rods 31 and is fixedly connected with the wall 5 of pool body 1, as best shown in FIGS. 36A, 38A and 40A. Locking connection member 32 includes a clamping slot 321 (FIG. 30) that includes a supporting transverse rod 33 (FIGS. 36A, 38A and 40A) installed at the edge of the pool. Clamping slot 321 is movably installed with an inner lining 322 which can match the supporting transverse rod 33 of different widths or shapes, thus providing wide applicability for varying specifications of pool 50.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pool comprising:

a pool body including a wall and a bottom defining an inner cavity configured to receive water;

a pillar positioned within the inner cavity, the pillar coupled to the bottom of the pool body;

wherein the pillar is connected to the bottom of the pool body by a connecting strap that couples a bottom surface of the pillar to the bottom of the pool body; and wherein the pillar cooperates with the wall of the pool body to define an annular lane therebetween; and a flow generating device configured to drive the water to flow and cycle in one direction within the annular lane, the flow generating device further including a motor positioned in the annular lane and a positioning device connecting the motor to the pool body within the inner cavity, the positioning device comprising at least one of a magnet and an adhesive.

2. The pool of claim 1, wherein the positioning device comprises:

a tensionable strap attached to the pool body; and a retaining ring attached to the motor, the tensionable strap selectively fixable to the retaining ring to thereby selectively join the motor to the pool body.

3. The pool of claim 1, wherein the positioning device comprises a porous bag or cover attached to the pool body, the motor restrained by the porous bag or cover.

4. The pool of claim 1, further including a motor cavity arranged within the inner cavity of the pool body and at a periphery of the annular lane, the motor cavity sized and configured to receive the motor within the motor cavity by the positioning device.

5. The pool of claim 4, wherein:

the motor is configured to direct an output water flow along a central axis of the motor; and the motor is configured to draw an input water flow from the periphery of the motor.

6. The pool of claim 4, wherein:

an input end of the motor spaced away from the annular lane is connected to the annular lane by a water pipe; and the water pipe is positioned to direct an input water flow to the motor from the annular lane, and an output water flow is directed back to the annular lane via the motor.

7. The pool of claim 1, wherein:

the motor is contained in a shell including a bottom surface and a side surface each having a water inlet formed therein;

an output shaft of the motor is connected to an impeller;

a fairing is disposed adjacent the impeller to receive an outlet flow from the motor, the fairing operable to direct the outlet flow along a desired direction, such that water flows into the motor from one of both of the water inlets, and is discharged in the desired direction via the fairing.

8. A pool comprising:

a pool body including a wall and a bottom defining an inner cavity configured to receive water;

a pillar positioned within the inner cavity and cooperating with the wall of the pool body to define an annular lane therebetween, the pillar connected to the bottom of the pool body by a connecting strap that joins a bottom surface of the pillar to the bottom of the pool body, the pillar; and a flow generating device comprising a motor configured to drive the water to flow and cycle in one direction within the annular lane; and a hanging device comprising:

a hanging member with an upper end hanging to an edge of the pool; and a mounting member connected to the hanging member, the mounting member configured to be fixed to the motor, the mounting member including a main body and an angle adjustment mechanism, wherein one side of the main body is fixedly connected with the motor, and the other side of the main body faces the wall of the pool and is connected to the angle adjustment mechanism, and the angle adjustment mechanism having an abutting block movable towards the wall of the pool and the abutting block connected with the wall of the pool.

9. The pool of claim 8, wherein the angle adjustment mechanism comprises a reversing mechanism operable to transform a movement parallel to the main body into a movement perpendicular to the main body.

10. The pool of claim 9, wherein:

the reversing mechanism comprises a screw rod, a screw arbor threadably engaged with the screw rod, a first connecting rod and a second connecting rod;

a first end of the first connecting rod is linked to the screw arbor, and a first end of the second connecting rod is rotatably connected to the main body; and a second, opposing end of the first connecting rod is hinged to a second, opposing of the second connecting rod and is connected with the abutting block.

11. The pool of claim 10, wherein the hinged ends of the first connecting rod and the second connecting rod are connected with the abutting block via a universal ball joint.

12. The pool of claim 11, wherein:

the main body includes an accommodating groove along a longitudinal direction of the main body, the screw arbor and the screw rod being positioned in the accommodating groove;

the upper end of the screw rod is exposed from an upper end face of the main body through the accommodating groove;

a handle is connected with the screw rod, and is operable to drive the screw rod to rotate so as to drive the screw arbor to move up and down along a longitudinal extent of the screw rod.

13. The pool of claim 12, wherein:

the upper end face of the main body includes a platform extending toward the inner cavity of the pool;

the platform has a through groove with a connector positioned within the groove; and the connector has a slot extending in a vertical direction along the connector.

14. The pool of claim 13, wherein:

the connector includes three slots, wherein one of the slots is a common slot and the other two are function slots;

the hanging member comprises two parallel vertical rods;

an end of each vertical rod is inserted in a respective slot, and an opposing end is bent to form a hook;

a locking connection member passes through the hook and is fixedly connected to the hook;

the locking connection member includes a clamping slot which is connected to a supporting transverse rod installed at the edge of the pool.

15. The pool of claim 8, wherein:

the motor is positioned outside a primary volume of the annular lane and away from the part of annular lane used by swimmers a water inlet pipe and an outlet pipe are connected between the annular lane and the motor, such that water flows from the annular lane, into the water inlet pipe, and returns to annular lane via the outlet pipe.

16. The pool of claim 15, wherein the motor is one of a centrifugal pump and an axial pump.

17. A pool comprising:

a pool body including a wall and a bottom to define an inner cavity configured to receive water; and a pillar including a pillar body and a connecting strap, the pillar positioned within the inner cavity to define an annular lane between the wall of the pool body, the pillar coupled to the bottom of the pool body by the connecting strap that connects a bottom surface of the pillar body to the bottom of the pool body, wherein the pillar body is configured to float on a surface of water contained in the inner cavity under the action of buoyancy, the pillar body a small pool having a water compartment independent from the annular lane, and the connecting strap is in a tensioned state under the action of the buoyancy.

18. The pool of claim 17, further comprising a flow generating device configured to drive the water to flow and cycle in one direction within the annular lane.

19. The pool of claim 17, wherein:

the connecting strap comprises two connecting straps arranged in parallel along the pillar body;

a first end of the connecting strap is connected to the bottom surface of the pillar body, and a second, opposing end of the connecting strap is connected to the bottom of the pool body.

20. The pool of claim 17, wherein the connecting strap is connected to the bottom of the pool body by a weld.

21. The pool of claim 17, wherein the connecting strap is detachably connected with the bottom of the inner cavity of the pool body.

22. The pool of claim 21, wherein:

the bottom of the connecting strap includes a slot parallel to the bottom of the pool body, and a plurality of gaps interrupt the slot at intervals;

a plurality of horizontal pipes are inserted into the slot such that an end of each horizontal pipe is brought toward the end of another horizontal pipe and respective pairs of horizontal pipes are connected to one another via a connecting apparatus at respective gaps; and each connecting apparatus comprises:

a base having a thread formed therein, the base connected to the bottom of the pool body and disposed within a respective gap;

a pair of mounting studs each sized to receive one of the horizontal pipes and each having a mounting hole; and a nut sized to pass through each mounting hole and threadably engage with the thread of the base, such that the nut fixes one of the respective pairs of horizontal pipes to the bottom of the pool via the base and the pair of mounting studs.

23. The pool of claim 21, wherein:

the bottom of the connecting strap includes a slot parallel to the bottom of the pool body, and a plurality of gaps interrupt the slot at intervals;

a connecting apparatus includes a plurality of horizontal pipes that are inserted into the slot, wherein the opposite ends of the two horizontal pipes respectively include a detent and a divot sized to engaged the detent;

an end of a first horizontal pipe including the detent is inserted into and locked to an end of a second horizontal pipe including the divot by the interlocking of the divot and the detent;

a plurality of anchor points fixed to the bottom of the pool body and positioned to correspond to respective ones of the plurality of gaps, each of the plurality of anchor points having a ring with a longitudinal axis substantially parallel to the bottom of the pool body, at least one horizontal pipe passing through the ring such that the connecting strap is fixed to the bottom of the pool body via the plurality of horizontal pipes and the plurality of anchor points.

24. The pool of claim 21, further comprising:

a tensile sheet arranged on the connecting strap near the bottom of the pool body; and a nut connected to an end of the tensile sheet, the nut having a thread; and a base having a thread configured to engage the thread of the nut, the base fixed to the bottom of the pool body such that the nut fixes the tensile sheet to the bottom of the pool body via the base.

25. The pool of claim 17, wherein the pillar body comprises a platform suitable for providing a dry surface within the inner cavity of the pool body.

26. The pool of claim 17, wherein the pillar body comprises at least one of a chair and a waterbed.

27. A pool comprising:

a pool body including a wall and a bottom defining an inner cavity configured to receive water;

a pillar positioned within the inner cavity, the pillar coupled to the bottom of the pool body;

wherein the pillar is connected to the bottom of the pool body by a connecting strap that couples a bottom surface of the pillar to the bottom of the pool body; and wherein the pillar cooperates with the wall of the pool body to define an annular lane therebetween; and a flow generating device configured to drive the water to flow and cycle in one direction within the annular lane, the flow generating device further includes a motor positioned in the annular lane and a positioning device connecting the motor to the pool body within the inner cavity, the positioning device comprising:

a tensionable strap attached to the pool body; and a retaining ring attached to the motor, the tensionable strap selectively fixable to the retaining ring to thereby selectively join the motor to the pool body.

28. A pool comprising:

a pool body including a wall and a bottom defining an inner cavity configured to receive water;

a pillar positioned within the inner cavity, the pillar coupled to the bottom of the pool body;

wherein the pillar is connected to the bottom of the pool body by a connecting strap that couples a bottom surface of the pillar to the bottom of the pool body; and wherein the pillar cooperates with the wall of the pool body to define an annular lane therebetween; and a flow generating device configured to drive the water to flow and cycle in one direction within the annular lane, the flow generating device further including a motor positioned in the annular lane and a positioning device connecting the motor to the pool body within the inner cavity, the positioning device comprising a porous bag or cover attached to the pool body, the motor restrained by the porous bag or cover.

29. A pool comprising:

a pool body including a wall and a bottom defining an inner cavity configured to receive water;

a pillar positioned within the inner cavity, the pillar coupled to the bottom of the pool body;

wherein the pillar is connected to the bottom of the pool body by a connecting strap that couples a bottom surface of the pillar to the bottom of the pool body; and wherein the pillar cooperates with the wall of the pool body to define an annular lane therebetween; and a flow generating device configured to drive the water to flow and cycle in one direction within the annular lane, the flow generating device further including a motor positioned in the annular lane and a positioning device connecting the motor to the pool body within the inner cavity;

wherein the motor is contained in a shell including a bottom surface and a side surface, each having a water inlet formed therein;

wherein an output shaft of the motor is connected to an impeller; and wherein a fairing is disposed adjacent the impeller to receive an outlet flow from the motor, the fairing operable to direct the outlet flow along a desired direction, such that water flows into the motor from one of both of the water inlets, and is discharged in the desired direction via the fairing.

30. A pool comprising:

a pool body including a wall and a bottom defining an inner cavity configured to receive water;

a pillar positioned within the inner cavity, the pillar coupled to the bottom of the pool body;

wherein the pillar is connected to the bottom of the pool body by a connecting strap that couples a bottom surface of the pillar to the bottom of the pool body; and wherein the pillar cooperates with the wall of the pool body to define an annular lane therebetween;

a flow generating device configured to drive the water to flow and cycle in one direction within the annular lane, the flow generating device including a motor and a positioning device; and a motor cavity arranged within the inner cavity of the pool body and at a periphery of the annular lane, the motor cavity sized and configured to receive the motor within the motor cavity by the positioning device;

wherein the motor is configured to direct an output water flow around a central axis of the motor and draw an input water flow from the periphery of the motor.

31. A pool comprising:

a pool body including a wall and a bottom defining an inner cavity configured to receive water;

a pillar positioned within the inner cavity, the pillar coupled to the bottom of the pool body;

wherein the pillar is connected to the bottom of the pool body by a connecting strap that couples a bottom surface of the pillar to the bottom of the pool body; and wherein the pillar cooperates with the wall of the pool body to define an annular lane therebetween;

a flow generating device configured to drive the water to flow and cycle in one direction within the annular lane, the flow generating device including a motor and a positioning device; and a motor cavity arranged within the inner cavity of the pool body and at a periphery of the annular lane, the motor cavity sized and configured to receive the motor within the motor cavity by the positioning device;

wherein an input end of the motor is spaced away from the annular lane and is connected to the annular lane by a water pipe, the water pipe positioned to direct an input water flow to the motor from the annular lane, and an output water flow is directed back to the annular lane via the motor.

32. A pool comprising:

a pool body including a wall and a bottom to define an inner cavity configured to receive water; and a pillar including a pillar body and a connecting strap, the pillar positioned within the inner cavity to define an annular lane between the wall of the pool body, the pillar coupled to the bottom of the pool body by the connecting strap that connects a bottom surface of the pillar body to the bottom of the pool body, wherein the pillar body is configured to float on a surface of water contained in the inner cavity under the action of buoyancy, and the connecting strap is in a tensioned state under the action of the buoyancy, the connecting strap connected to the bottom of the pool body by a weld.

* * * * *